US006802416B1

(12) United States Patent
D'Alessio et al.

(10) Patent No.: US 6,802,416 B1
(45) Date of Patent: Oct. 12, 2004

(54) PACKAGE ASSEMBLY WITH APPLICATOR AND CONTAINER FOR ADHESIVE MATERIALS

(75) Inventors: Keith R. D'Alessio, Cary, NC (US); Gary F. Prokop, Wheaton, IL (US); Leonard F. Czuba, Lombard, IL (US); Carl F. Behrend, Chicago, IL (US); Peter J. Kopec, Park Ridge, IL (US); Upvan Narang, Raleigh, NC (US); Gabriel N. Szabo, Raleigh, NC (US); Anthony S. Voiers, Raleigh, NC (US); Cheryl A. Kennedy, Fuquay-Varina, NC (US)

(73) Assignee: Closure Medical Corporation, Raleigh, NC (US)

( * ) Notice: Subject to any disclaimer, the term of this patent is extended or adjusted under 35 U.S.C. 154(b) by 0 days.

(21) Appl. No.: 09/385,030

(22) Filed: Aug. 30, 1999

Related U.S. Application Data

(63) Continuation-in-part of application No. 09/145,200, filed on Sep. 1, 1998, now Pat. No. 6,372,313.
(60) Provisional application No. 60/138,049, filed on Jun. 8, 1999.

(30) Foreign Application Priority Data

Aug. 27, 1999 (WO) ..... PCT/US99/19553

(51) Int. Cl.[7] ..... B65D 69/00

(52) U.S. Cl. ..... 206/229; 523/118

(58) Field of Search ..... 206/229, 568, 206/570, 572, 484, 223; 523/118

(56) References Cited

U.S. PATENT DOCUMENTS

| | | | | |
|---|---|---|---|---|
| 2,119,646 A | | 6/1938 | Pidel | |
| 2,168,179 A | | 8/1939 | Tobey | |
| 3,083,821 A | * | 4/1963 | Woodson | 206/568 |
| 3,146,806 A | | 9/1964 | Ginsburg | |
| 3,315,689 A | | 4/1967 | Melik | |
| 3,491,875 A | * | 1/1970 | Fischer et al. | 206/1.7 |
| 3,524,537 A | * | 8/1970 | Winter | 206/484 |
| 3,559,652 A | | 2/1971 | Banitt et al. | |
| 3,638,785 A | * | 2/1972 | Casteel et al. | 206/229 |

(List continued on next page.)

FOREIGN PATENT DOCUMENTS

| | | |
|---|---|---|
| DE | 196 42 286 A1 | 4/1998 |
| EP | 0 402 140 A1 | 12/1990 |
| EP | 0 779 229 A1 | 6/1997 |
| EP | 0 857 658 A1 | 8/1998 |
| WO | WO 92/12863 | 8/1992 |
| WO | WO 97/31598 | 9/1997 |
| WO | WO 98/23220 | 6/1998 |

OTHER PUBLICATIONS

DAP Weldwood Contact Cement, Champion International, Dayton, Ohio ( © 1996).

*Primary Examiner*—John G. Weiss
*Assistant Examiner*—Michael J. Fisher
(74) *Attorney, Agent, or Firm*—Oliff & Berridge, PLC

(57) ABSTRACT

A package assembly or kit can be used in conjunction with storing and dispensing adhesive materials. The package assembly can include an enclosure in which an applicator and a container may be positioned. The container contains adhesive material. The enclosure may include a base and a cover. The base preferably includes one or more cavities, with at least one applicator disposed in one of the cavities. Further, the container may be disposed in another of the cavities. The cover may be provided with a plurality of wells. The container may include a restrictor positioned within a neck of the container. The restrictor is provided to limit the volume of adhesive material retained in an absorbent end of an applicator such as a swab. The package assembly can be provided in a sterilized condition.

71 Claims, 12 Drawing Sheets

U.S. PATENT DOCUMENTS 3,667,472 A 6/1972 Halpern
3,704,089 A 11/1972 Stehlik
3,759,375 A 9/1973 Nappi
3,938,898 A 2/1976 Reitknecht
3,976,195 A 8/1976 Cohen
4,035,334 A 7/1977 Davydov et al.
4,212,387 A * 7/1980 Kotski et al. ..... 206/568
4,294,349 A 10/1981 Ibsen et al.
4,329,990 A 5/1982 Sneider
4,364,473 A 12/1982 Bogaert
4,430,013 A 2/1984 Kaufman
4,612,252 A * 9/1986 Sagane et al. ..... 428/516
4,707,450 A 11/1987 Nason
4,724,177 A 2/1988 Russo
4,726,553 A 2/1988 Wischusen, III
4,767,398 A 8/1988 Blasius, Jr.
4,786,534 A 11/1988 Aiken
4,789,639 A 12/1988 Fleming
4,802,797 A 2/1989 Cole
4,828,113 A * 5/1989 Friedland et al. ..... 206/570
4,854,759 A 8/1989 Morane et al.
4,869,381 A 9/1989 Agner
4,875,602 A 10/1989 Chickering et al.
4,887,994 A * 12/1989 Bedford ..... 206/229
5,033,252 A 7/1991 Carter
5,106,297 A 4/1992 Discko, Jr.
5,123,431 A 6/1992 Wilson
5,152,742 A 10/1992 Simpson
5,240,415 A 8/1993 Haynie
5,241,803 A 9/1993 Griffin
5,308,180 A 5/1994 Pournoor et al.
5,333,737 A * 8/1994 Clark ..... 206/568
5,370,221 A 12/1994 Magnusson et al.
5,378,226 A 1/1995 Hanifl et al.
5,403,591 A 4/1995 Tighe et al.
5,474,206 A 12/1995 Herring, Sr.
5,480,935 A 1/1996 Greff et al.
5,490,737 A 2/1996 Gueret
5,525,647 A 6/1996 Eichmiller
5,530,037 A 6/1996 McDonnell et al.
5,575,997 A 11/1996 Leung et al.
5,580,565 A 12/1996 Tighe et al.
5,582,834 A 12/1996 Leung et al.
5,597,254 A 1/1997 Vasas
5,599,125 A 2/1997 Vasas et al.
5,653,769 A 8/1997 Barley, Jr. et al.
5,660,273 A 8/1997 Discko, Jr.
5,697,720 A 12/1997 Lhuisset
5,709,866 A 1/1998 Booras et al.
5,779,053 A 7/1998 Partika et al.
5,842,326 A 12/1998 Wolf
5,857,991 A 1/1999 Grothoff et al.
5,859,076 A * 1/1999 Kozma et al. ..... 521/79
5,860,806 A * 1/1999 Pranitis et al. ..... 206/63.5
5,874,044 A 2/1999 Kotzev
5,881,536 A 3/1999 Müller-Wille et al.
5,900,245 A 5/1999 Sawhney et al.
5,909,976 A 6/1999 Maeda
5,981,621 A * 11/1999 Clark et al. ..... 523/118
6,000,575 A 12/1999 LaCour et al.
6,143,805 A * 11/2000 Hickey et al. ..... 523/118
6,342,213 B1 1/2002 Barley et al. ..... 424/78.35
6,386,781 B1 5/2002 Gueret

* cited by examiner

PACKAGE ASSEMBLY WITH APPLICATOR AND CONTAINER FOR ADHESIVE MATERIALS

This is a Continuation-in-Part of application Ser. No. 09/145,200 filed Sep. 1, 1998, now U.S. Pat. No. 6,372,313 and claims the benefit of U.S. Provisional Application No. 60/138,049 filed Jun. 8, 1999. The entire disclosures of the prior applications are hereby incorporated by reference herein in their entirety.

BACKGROUND OF THE INVENTION

1. Field of Invention

This invention relates to a package assembly for adhesive materials.

2. Description of Related Art

Adhesive materials are conventionally stored in a storage tube or other similar device that includes a dispensing tip. Illustratively, U.S. Pat. No. 4,364,473 to Bogaert discloses an adhesive material stored in a tube. The storage tube may be constructed of an elastic or resilient material, such that the storage tube is squeezed to decrease the interior volume of the tube. When a user wants to apply a portion of the adhesive on a surface, the user positions the dispensing tip adjacent to or on the surface. The user then squeezes the tube to force a quantity of the adhesive material out. The adhesive flows out of the tube and onto the surface. However, there are various drawbacks to this arrangement, especially with applications of certain types of adhesives and applications of adhesives in certain environments.

Illustratively, it is difficult to apply adhesives with low viscosity using conventional devices. If the low viscosity adhesive is stored in a tube the user will squeeze the tube to dispense a quantity of the adhesive. However, it is difficult to squeeze the tube such that the correct amount of adhesive is dispensed. It is often the case that the tube is squeezed too much and a large quantity of the adhesive is dispensed. As a result, the adhesive may flow into areas to which the user did not intend to apply the adhesive. This results in possible damage to the surface as well as the necessity for the user to take away the excess adhesive. In turn, this also results in waste of the adhesive product.

An alternative approach to applying an adhesive is to initially apply the adhesive onto an applicator and then onto the surface. One example of this is disclosed in U.S. Pat. No. 5,333,737 to Clark. In such an approach, a user squeezes the tube, for example, containing the adhesive so as to apply a portion of the adhesive onto the applicator. The applicator is then moved into physical contact with the surface so that a portion of the adhesive is applied to the surface. However, with low viscosity adhesives, the adhesive may run off the applicator before it is adjacent the surface. This results in both waste of the adhesive and in possible harm, since excess adhesive may be deposited in an area where it is not wanted.

Further, a problem arises if the tube of adhesive is to be used more than once, as is common. If a user chooses to apply the adhesive directly from the tube onto the surface, and not to use an applicator, the dispensing tip may contact the surface upon which the adhesive is being applied. Over multiple uses, contaminants may be transferred from one surface to another surface. As is apparent, this is especially of concern with the application of adhesives in the medical field.

Further, there are other problems associated with conventional techniques with the application of adhesives in certain environments, such as environments in which the surface is difficult to reach or isolated. If a user wishes not to use an applicator, it is necessary for the dispensing tip of the tube to be adjacent to or on the surface. However, the tube may not easily fit within the spatial constraints in which the surface is located. As a result, the spatial constraints may limit applications using only the tube and force a user to use an applicator. This raises a further problem in that an appropriate applicator may not be conveniently available.

Accordingly, conventional devices fail to address the various drawbacks discussed above, as well as others. As described above, U.S. Pat. No. 4,364,473 to Bogaert discloses a tube containing an adhesive material. More specifically, Bogaert is directed to an arrangement for repairing a dental prosthesis including a package containing the tube of adhesive, bottles containing a monomer and a polymer and a support. Bogaert teaches using the tube to apply the adhesive directly on the prosthesis. This raises concerns of contamination as described above. Further, the tube of Bogaert would not be usable in some situations where there are spatial constraints and the tube could not be effectively maneuvered so as to apply the adhesive.

Accordingly, known devices do not effectively address the drawbacks described above, as well as others. Conventional devices fail to provide an applicator that is optimized for convenient dispensing and application of adhesive materials on a variety of surfaces and structures.

SUMMARY OF THE INVENTION

An object of the invention is to address the need for an easy to use and efficient package assembly for dispensing and applying an adhesive material, preferably a medical adhesive.

Also, the invention is directed to the application of monomer compositions and polymers formed therefrom, in industrial and home applications, for example in bonding rubbers, plastics, glass, metal, wood, composites, fabrics, and other natural and synthetic materials. Included among these adhesives are the 1,1-disubstituted ethylene monomers and polymers, including cyanoacrylates such as the α-cyanoacrylates. Since the discovery of the adhesive properties of such monomers and polymers, they have found wide use due to the speed with which they cure, the strength of the resulting bond formed, and their relative ease of use. These characteristics have made the α-cyanoacrylate adhesives the primary choice for numerous applications such as bonding plastics, rubbers, glass, metals, wood, and, more recently, biological tissues. The invention provides an easy and efficient approach to apply these adhesives.

In particular, the invention provides a package assembly or kit to hold and apply an adhesive material conveniently, inexpensively and effectively. The kit includes an enclosure which contains at least one container of adhesive material and at least one applicator. The applicator includes at least one absorbent portion for absorbing adhesive to be applied.

In embodiments of the invention, the enclosure includes separate compartments. A plurality of applicators are contained within the enclosure. In some embodiments, each of the applicators includes a shaft having two ends and an absorbent portion at one or each end of the shaft. The two absorbent portions may be differently configured for wiping and drying a surface to be treated, and for applying adhesive, respectively. Separate compartments are provided for holding at least one container and the applicators. A plurality of the applicators is held within one or more of the separate compartments. Further, in embodiments separate compartments holding the applicators may be separable from the enclosure.

In embodiments, the enclosure includes a base and a cover. The cover has a surface facing an interior of the enclosure when the enclosure is closed, with wells disposed on the surface. The wells are configured to hold an adhesive material dispensed from a container when the enclosure is open. The enclosure may include at least the same number of the wells as a number of the applicators.

In embodiments of the invention, the container includes an internal lumen, a closable opening, and a bottom portion. The container is configured to be self-supportable on the surface with the opening facing upwardly. A restrictor may extend into the internal lumen of the container and define the opening of the container. The bottom portion of the container and a suction cup are configured to be connected together. The suction cup holds the container to the surface. The opening of the container and an applicator are configured to allow at least an absorbent portion of the applicator to pass through the opening into the container and to compress the absorbent portion.

In embodiments of the invention, a container assembly includes at least one container, an adhesive material within the container, and at least one applicator removably connectable to the container. The applicator includes at least one absorbent portion. In some embodiments, the applicator and/or container includes an applicator retainer that removably retains the applicator. A preferred applicator includes a shaft having a first end and a second end and a through-passage extending from the first end to the second end. The adhesive material can be dispensed through the through-passage and applied to a surface to be treated.

In embodiments of this invention, the adhesive material can be sequentially sterilized -e.g., once before being placed in the container for the adhesive, after being placed in the container, and optionally after the container and adhesive are placed in an enclosure—in embodiments of the package assembly. In such embodiments, the adhesive material can be subjected to sequential sterilization procedures with substantially no polymerization of the adhesive material occurring.

BRIEF DESCRIPTION OF THE DRAWINGS

Embodiments of this invention will be described in detail with reference to the following figures, wherein.

DETAILED DESCRIPTION OF PREFERRED EMBODIMENTS

Figure 2:
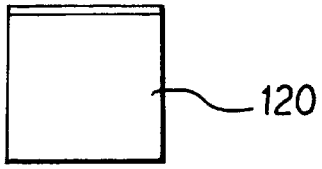
FIG. 2 is a top plan view showing the package of FIG. 1.

Aspects of this invention are directed to a package assembly or kit which includes a container of adhesive as well as an applicator. The package assembly according to this invention can be used in conjunction with a wide variety of applications of adhesive material, wherein it is necessary or desirable to efficiently and easily apply an adhesive material. Examples include, but are not limited to, those applicable to medical, industrial, and home use. For example, the package assembly in accordance with the invention may be used to apply monomeric adhesive compositions, such as an adhesive for the treatment of surgically incised or traumatically lacerated tissues; retarding blood flow from wounds; dressing burns; dressing skin or treating stomatitis or other superficial or surface sores or wounds. The package assembly may be used to store and apply a wide variety of adhesives, including polymerizable liquid adhesives such as 1,1-disubstituted ethylene monomers and polymers, including cyanoacrylate monomers such as the $\alpha$-cyanoacrylates. Especially useful liquid adhesives include the adhesives described in copending U.S. patent applications Ser. Nos. 09/099,457 and 08/488,411, the disclosures of which are hereby incorporated by reference in their entireties. As used herein, "adhesive" or "adhesive material" includes, but is not limited to a monomeric formula or a monomeric composition that is reacted or unreacted. For example, in the invention adhesive is intended to encompass a monomeric formula that polymerizes when applied to the surface of the skin.

One particular application of the package assembly of the invention is in conjunction with the storage and application of adhesive materials for medical or surgical procedures. It should be appreciated that any known or later developed adhesive material can be used in conjunction with the invention.

A package assembly or kit in accordance with the invention preferably includes an enclosure. The enclosure contains at least one container and at least one applicator. The container contains an adhesive material. The applicator includes at least one absorbent portion. The enclosure may be any of a variety of shapes and designs dependent on numerous factors including the specific contents of the enclosure and the intended use of the adhesive contained within the enclosure, for example.

In embodiments, the enclosure includes a base and a cover for the base. The base includes one or more applicator cavities for holding and retaining one or more applicators. The base may further include a container cavity for holding and retaining the container of adhesive material. The cover is preferably movably connected to the base. For example, the cover may be removable or may be pivotably attached to the base using a line of weakness or hinges separating the cover from the base.

In embodiments, the cover or base, but preferably the cover, includes a plurality of wells formed on its surface. The wells may temporarily hold small quantities of the adhesive material into which the absorbent portion of the applicator may be dipped (dip wells), or can catch and retain drops resulting from application of the adhesive material to the applicator (drip wells).

In embodiments, the base includes a facing surface. The cover is pivotable between a first position and a second position. In the first position, the cover surface opposes the facing surface of the base. In the second position, the cover surface faces in the same direction as the facing surface of the base. In such a manner, the wells that are disposed in the cover are exposed for use when the cover is in the second position.

In embodiments, applicator cavities are positioned in the base and have an elongated shape. In preferred embodiments, the base includes two applicator cavities and a single container cavity. The two applicator cavities may be positioned side by side. A plurality of applicators may be positioned in a single applicator cavity. For example, the applicators may be stacked within a single applicator cavity.

In embodiments, the enclosure includes one or more applicator cavities that may be separated along a breaking line. The breaking line may be weakened and broken in some manner, such as by a perforation. As a result, the respective cavity portions and associated applicators may be easily separated from each other.

In embodiments, applicator cavities for respective individual applicators are positioned in a holding portion of the package assembly. The applicator cavities may be shaped to match the shape of the applicators. For example, a first well may be positioned at the first end of the applicator cavity, a second well at the second end of the applicator cavity, and a connection portion may extend between the first well and the second well. This provides a neat and predictable location for the applicators and the applicator cavities themselves may act as dip or drip wells. This is particularly advantageous in embodiments where the applicator cavity portions may be separated from the rest of the enclosure and discarded after use.

In further embodiments, the container may include a vessel portion and a neck. A restrictor is positioned and supported in the neck of the container. The restrictor includes a passage extending between ends and along the length of the restrictor. The restrictor may be formed of any suitable material that is compatible with the adhesive, such as resilient plastics material, for example.

In embodiments, an absorbent end of an applicator may be passed through the restrictor into the container. Provided there is sufficient adhesive material contained in the container, the absorbent end of the applicator will absorb a portion of the adhesive material. Thereafter, the applicator including the absorbent end is withdrawn from the receptacle and is withdrawn back through the restrictor. The restrictor diminishes the size of the absorbent end, i.e., compresses and wipes the absorbent end of the applicator. As a result, the volume content of adhesive material retained within the absorbent end of the applicator is both limited and controlled. Use of the wells with such embodiments is therefore optional. In addition, the restrictor extending into the container can reduce or prevent spillage when the container is tipped.

Further, in embodiments, the container includes a base connected to its lower portion. In embodiments, the base may include a center support and a suction cup. The suction cup is positioned on a lower portion of the center support and can hold the container in place to permit one-handed application of the adhesive. The base may also include at least one extension or stabilizer for supporting the container against tipping on the suction cup. The extension may, for example, comprise a skirt. The skirt is annular in shape and defines a skirt interior space. The base may be integrally formed with or reversibly attached to the container.

In embodiments, the container base further includes a locking retainer integrally formed with or reversibly attached to the skirt. The locking retainer defines a receiving cavity having an interior in which the container is positionable. The receiving cavity is substantially circular in shape and includes an interior surface. The interior surface of the receiving cavity includes a locking channel defined therein. A locking ring disposed on an exterior surface of the container is matingly engageable with the locking channel.

In embodiments, a container assembly includes at least one container, an adhesive material within the container, and at least one applicator removably connectable to the container. The applicator includes at least one absorbent portion. In some embodiments, the applicator and/or the container includes an applicator retainer that removably retains the applicator. Embodiments of the applicator include a shaft having a first end and a second end and a through-passage extending from the first end to the second end. The adhesive material can be dispensed through the through-passage and applied to a surface to be treated. In some embodiments, a flow control element is provided in the through-passage to limit and/or control fluid flow through the through-passage, particularly back into the container after initiation has occurred.

In embodiments, the adhesive material can be sequentially sterilized. For example, the material can be sterilized before being placed in the container for the adhesive, as well as again after being placed in the container. Further, the container and adhesive can be sterilized after the container and adhesive are placed in an enclosure in embodiments of the package assembly. In such embodiments, the adhesive material can be subjected to sequential sterilization procedures with substantially no polymerization of the adhesive material occurring.

The invention offers a user simple and effective storage and application of an adhesive. The simplicity of the invention permits it to be used with little or no instruction prior to its use. Further, the construction of the invention includes a limited number of moving parts. The invention may be utilized easily and effectively in a wide variety of environments and in an expeditious manner.

The invention will be further described in conjunction with the accompanying figures showing exemplary embodiments of the invention. In the figures, like numerals have been used to identify like components.

Figure 1:
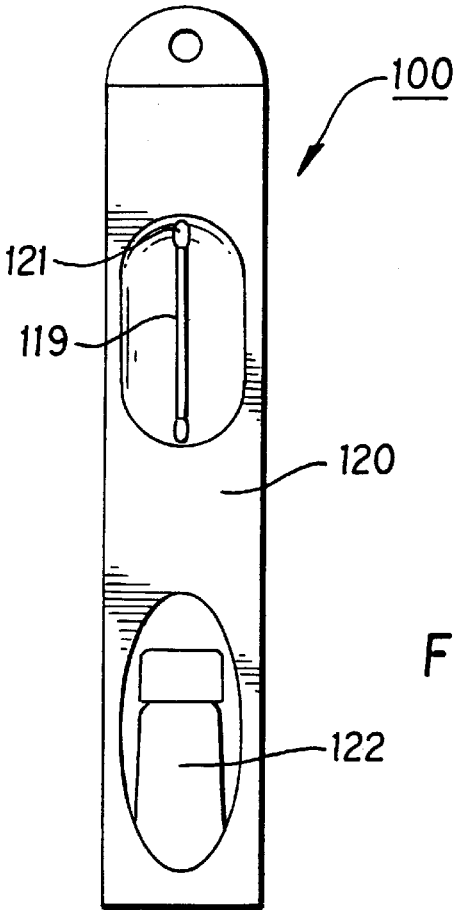
FIG. 1 is a side plan view of a container and applicator positioned in an enclosure of the invention.

FIGS. 1 and 2 show a package assembly or kit 100 in accordance with an embodiment of the invention to hold and apply an adhesive material conveniently, inexpensively and effectively. The kit includes an enclosure 120. The enclosure 120 contains at least one container 122, which contains an adhesive material, and at least one applicator 119. The applicator 119 includes at least one absorbent portion 121. The enclosure 120 may be any of a variety of shapes and designs dependent on numerous factors including the specific contents of the enclosure and the intended use of the adhesive contained within the enclosure, for example.

When a user wants to apply the adhesive to a surface, for example, the user opens the enclosure 120 and removes an applicator 119 and container 122 from the enclosure 120. Thereafter, the user may drip, for example, an amount of the adhesive onto the absorbent portion 121 of the applicator or may dip the absorbent portion of the applicator into the adhesive in the container. Then, the absorbent portion 121 is moved so as to make physical contact with the surface upon which the adhesive is to be applied. When physical contact is made, the absorbent portion 121 will be compressed. As a result, adhesive will be released from the absorbent portion 121 onto the surface.

Figure 3:
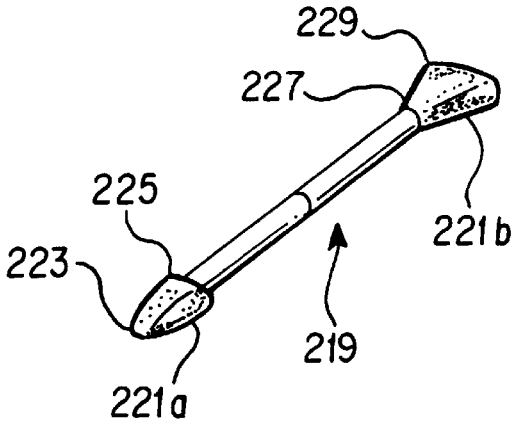
FIG. 3 is a perspective view showing an applicator in accordance with embodiments of the invention.

For example, an applicator 219 in accordance with embodiments of the invention may be constructed as shown in FIG. 3. The applicator 219 includes a first absorbent end 221*a* and a second absorbent end 221*b*. The absorbent ends 221 may be constructed of absorbent foam or fibrous pad material, for example. The absorbent end 221*a* in FIG. 3 is tapered such that the tip 223 of the absorbent end is smaller in dimension than the base 225. The absorbent end 221*b* is tapered such that the tip 229 of the absorbent end is wider in dimension than the base 227. Further, the tip 229 of the absorbent end 221*b* is wider than the base 225 of the absorbent end 221*a*. Such a construction can be useful to keep the applicator from falling into the container when dipped in through an opening that accommodates end 221*a* but not end 221*b*. The dimensions of the applicator 219 allow the applicator to be used to apply adhesive in a variety of environments and spatial constraints. The embodiment of FIG. 3 is particularly desirable when the surface to be treated needs to be dried before the adhesive is applied. The wider end of the applicator can be used for drying the surface, and then the tapered end can be used to apply the adhesive, for example.

However, it should be recognized that the applicator 219 shown in FIG. 3 is only illustrative and not limiting. For example, the applicator may include only one absorbent end. Further, the absorbent end or ends of the applicator may be a wide variety of shapes and sizes such as circular, elliptical, elongated, curved or square depending on the particular application of the adhesive. Also, in embodiments, the absorbent end could be in the form of a brush and constructed of foam. For example, an elongated, absorbent end constructed of open cell or closed cell foam may be particularly useful in the application of adhesives to treat stomatitis.

Some foam materials that can be used to form the absorbent end(s) of the applicator 219 are sensitive to exposure to ultraviolet (UV) light, which may cause these materials to change color. For example, polyurethane foam materials tend to change color when exposed to UV light, such as by yellowing. These changes in color are noticeable and can make the foam material undesirable or aesthetically unappealing for some uses. White foam materials are particularly susceptible to such color changes and will often develop an unsightly appearance as they age.

One suitable approach is to use colored foam materials. Surgical green is Applicants' preference.

In order to provide a longer stability against color changes of the foam materials of the applicators, in embodiments, a UV stabilizing agent is included in the enclosure 120 to protect the foam materials of the applicators contained in the enclosure 120 from UV radiation. The UV stabilizing agent of the enclosure 120 helps maintain the original color of the foam. In some embodiments, the UV stabilizing agent is compounded into the material that is used to form the enclosure 120. For example, the enclosure 120 can be formed of any suitable plastic material and a UV stabilizing agent can be compounded into the plastic material. In other embodiments, the UV stabilizing agent can be applied onto at least a portion of the inner and/or outer surface of the enclosure 120. For example, the UV stabilizing agent can be selectively applied on at least a portion of the inner and/or outer surface of the enclosure that directly surrounds the applicators.

Any suitable UV stabilizing agent can be added to the material forming the enclosure 120. For example, suitable UV stabilizers include, but are not limited to, UV absorbers such as benzophenone compounds, benzotriazole compounds, benzoxazole compounds, butadiene compounds, cinnamate compounds, s-triazine, cyanoacrylate compounds, oxanilide compounds and the like. The UV stabilizer compound can be incorporated into the material forming the enclosure 120 in any suitable amount to provide the desired UV stabilization and protection functions.

It will be understood that a UV stabilizing agent may be included in any of the enclosures for applicators described herein to provide the UV stabilization and protection functions to the enclosures and protect the foam materials of the applicators from degradation due to exposure to UV radiation.

In embodiments, a UV stabilizing agent may also be incorporated into the foam material of the absorbent end(s) of the applicator 219. Further, a UV stabilizing agent may also be added directly to the foam materials used to form the absorbent end(s) of any of the other exemplary embodiments of the applicator described herein, such as the applicator 119.

It will be understood that a UV stabilizing agent may also or alternatively be incorporated into any of the container assemblies described herein to provide protection against UV light exposure.

Figure 4A:
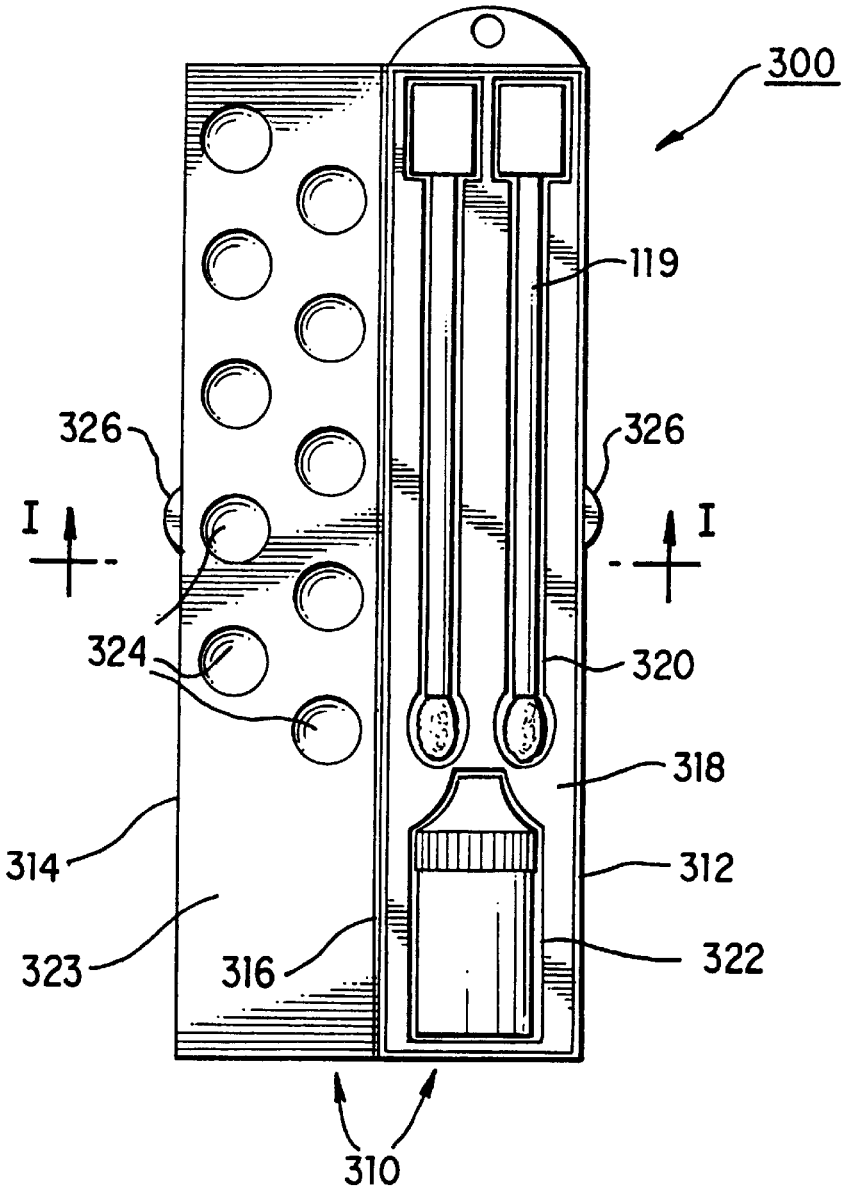
FIG. 4A is a top plan view of a package assembly including a cover with wells in accordance with embodiments of the invention.

FIGS. 4A, 4B, 4C and 5 show an enclosure or package assembly 300 in accordance with an embodiment of this invention. As shown in FIG. 4A, the package assembly 300 includes an enclosure 310. Enclosure 310 includes a base 312 and a cover 314. The cover 314 is movably attached to the base 312. For example, the cover 314 may be pivotally attached to the base 312 using a hinge 316 or weakened portion.

The base 312 is elongated and includes a facing surface 318 and a plurality of cavities formed within the facing surface 318. Specifically, the base 312 includes a plurality of applicator cavities 320 and a single container cavity 322. The applicator cavities 320 are formed in the shape of an elongated slot and extend along the length of the base 312. A first and second applicator cavity 320 may be positioned side by side as shown in FIG. 4A. However, the invention is not limited to two adjacent applicator cavities 320. For example, a single cavity might be provided, in which applicators are positioned side by side.

The base 312 also includes the container cavity 322 positioned adjacent the applicator cavities 320. As shown in FIG. 4A, the container cavity 322 is positioned at one end of the applicator cavities 320 and centered relative to the width of the applicator cavities 320. The base 312 may be constructed using various constructs including a separate outer shell and inner shell, wherein the cavities are formed in the inner shell, for example. Alternatively, the base 312 may be constructed of a single unitary piece of material.

The base 312 may be sized to contain a desired number of applicators and containers. For example, in some embodiments, the base may be sized such that ends of the base 312 have a width substantially equal to their depth.

Further, the base 312 may contain an open cavity and an insert contained in the open cavity. The insert may include a plurality of dividers including slits and folds, for example, so as to form chambers in which to hold the container containing adhesive and the applicators, for example. The insert may be of any suitable material such as plastics, cardboard, paperboard or others. The invention is not limited to such an arrangement and the base 312 may be formed in a wide variety of arrangements so as to hold the contents thereof.

The container cavity 322 may hold the container 122, for example, shown in FIG. 1, as well as a wide variety of containers of different shapes, sizes and constructs. Further, it should be recognized that a wide variety of containers or receptacles may be used in embodiments of the invention. For example bottles with screw on lids, snap on lids, sealed pouches, or tubes may be used. For example, a foil tube similar to a traditional toothpaste container, preferably with a puncturable foil seal, may be utilized.

The cover 314 includes a cover surface 323. The cover 314 is movable between a first position, wherein the cover surface 323 opposes the facing surface 318 of the base 312, and a second position, wherein the cover surface 323 faces in the same direction as the facing surface 318. A plurality of wells 324 is disposed on the cover surface 323. Specifically, as shown in FIG. 4A, the wells 324 may be arranged in two sets of five, wherein the sets extend in a linear fashion along a portion of the length of the cover surface 323. However, the invention is not limited to such arrangement and the wells 324 may be arranged in a wide variety of arrangements. Further, the wells 324 may be concentrated along a certain portion of the cover 314, as shown in FIG. 4A. The wells 324 may be formed into any of a diverse variety of shapes. Illustratively, the wells 324 shown in FIG. 5 define the shape of a portion of a sphere. Alternatively, the wells could be oval, for example, or any other shape.

The wells 324 may be used in a plurality of manners. Illustratively, a user may apply a quantity of adhesive material onto an absorbent end 121 of a swab 119 by dripping the adhesive material from a bottle. However, a common problem with such a procedure is overdrip. Accordingly, the wells 324 serve as a reservoir to catch and retain drops resulting from overdrip. Alternatively, adhesive can be dispensed directly into the wells, and the applicator is then dipped into the wells. This can provide somewhat better control over the amount and location of adhesive on the applicator.

Figure 4B:
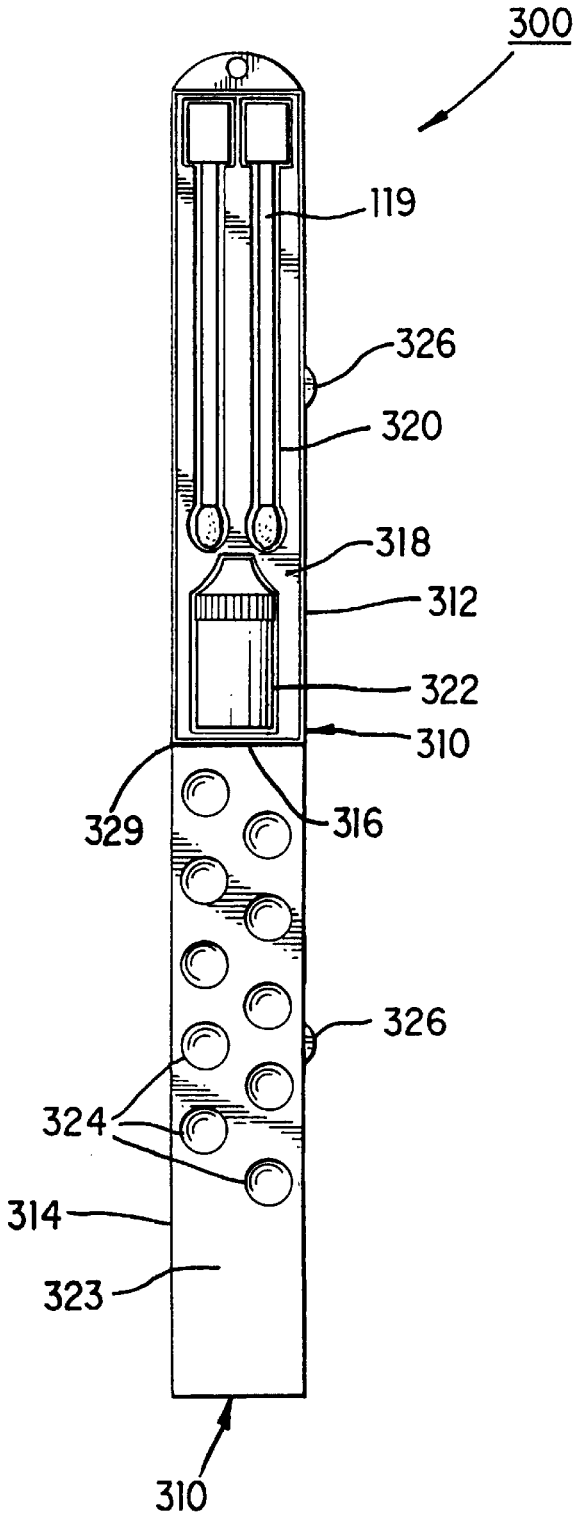
FIG. 4B is a partially broken away, top plan view of another package assembly including a cover with wells in accordance with embodiments of the invention.

FIG. 4B shows another enclosure or package assembly in accordance with embodiments of the invention. Like reference numerals have been used in FIG. 4B, as in FIG. 4A, to designate like components. FIG. 4B illustrates that the cover 314 may be movably attached to the base 312 at an end 329, rather than a side, as shown in FIG. 4A. The arrangement shown in FIG. 4B is advantageous in that a user may easily hold the opened enclosure 310 using a single hand. However, it should be recognized that in accordance with the invention the interrelationship of the base 312 and the cover 314 is not limited to the arrangement shown in FIG. 4A or FIG. 4B, but rather may be a wide variety of shapes and designs.

Figure 4C:
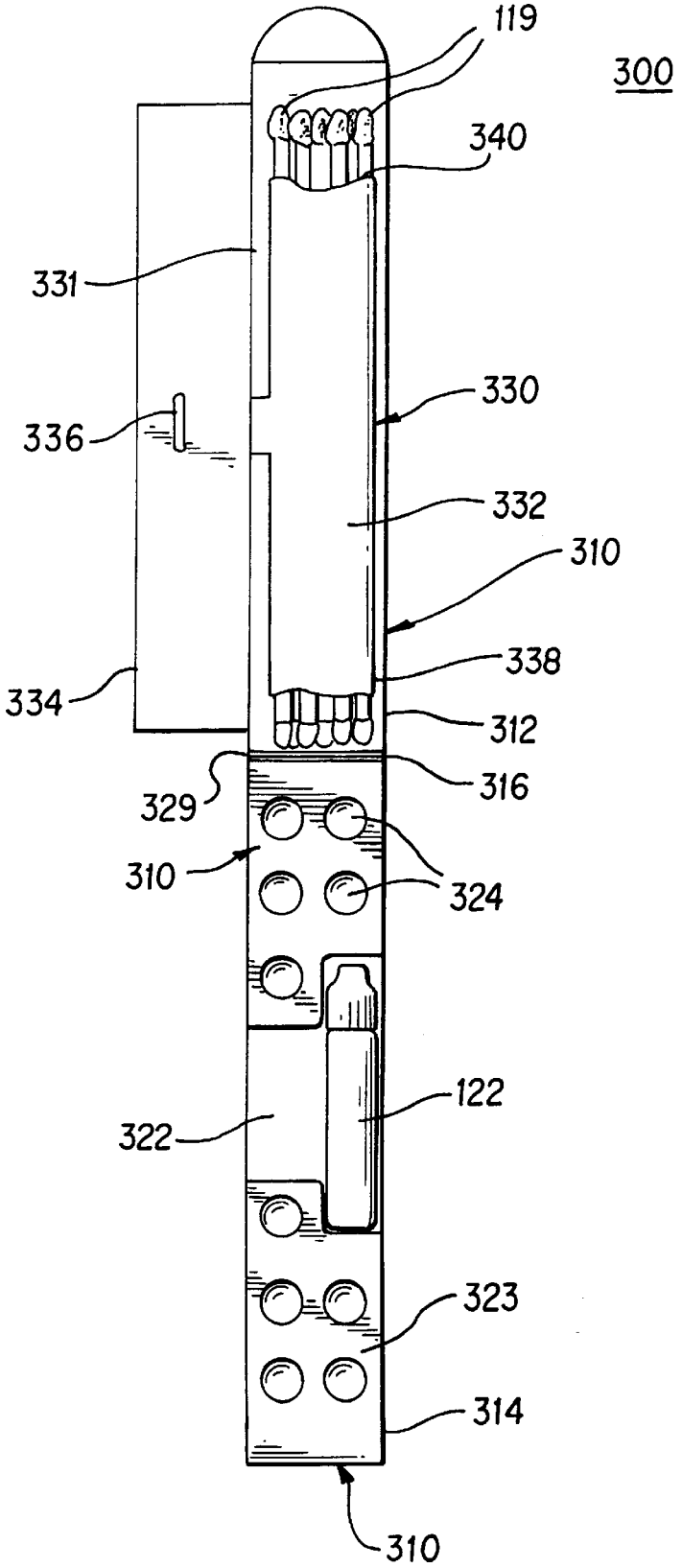
FIG. 4C is a top plan view of another package assembly including a cover with wells in accordance with embodiments of the invention.

FIG. 4C shows another enclosure or package assembly in accordance with embodiments of the invention. Like reference numerals have been used in FIG. 4C, as in FIGS. 4A and 4B, to designate like components. FIG. 4C illustrates the cover 314 movably attached to the base 312 at an end 329. An optional insert 330 may be placed on the base 312. The insert 330 may include an inner portion 332, which may be received within a cavity 331 of the base 312, and an outer portion 334 which is substantially exterior to the base 312 when the inner portion 332 is in the cavity 331. The insert may be formed of any suitable material such as plastics, cardboard, paperboard or others. The inner portion 332 may be open at neither, one or both ends 338, 340. A plurality of applicators 119 are provided inside of the inner portion 332. The applicators 119 may include two absorbent ends as shown, or alternatively may include only one absorbent end.

The cover 314 includes a plurality of wells 324 on the facing surface 323. In addition, the cover 314 defines a container cavity 322 generally between the wells 324, which receives a container 122. The cover may be sized to include any desired number of wells 324 and to contain any desired number of containers 122. The container cavities and containers are preferably sized and shaped to provide an effect that cavity walls hold the container in place.

The applicators 119 are accessed by removing the insert 330 from the base 312 and removing a desired number of applicators 119. After the applicators 219 are removed from the insert 330, the insert is placed back into the cavity 331 of the base 312. Insert 330 could be alternatively shaped to hold the applicators or could be eliminated, with the applicators being loose or held by shapes on the cavity walls and/or floor.

An opening 336 may be formed in the outer portion 334 to receive a hanging element such as a hook to enable the package assembly 300 to be supported on a display when the cover 314 is in the closed position. Label information may also be provided on the insert 330 if desired.

Figure 5:
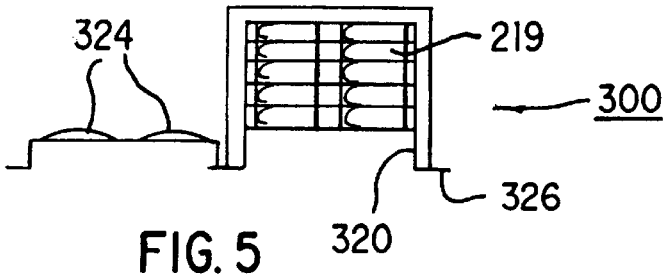
FIG. 5 is a side cross-sectional view of the package assembly of FIG. 4A along the line I—I.

FIG. 5 is a cross-sectional view of the package assembly 300 of FIG. 4A along the line I—I in FIG. 4A. FIG. 5 shows that the applicator cavity 320 may be provided with a sufficient depth so as to accommodate a plurality of applicators, such as swabs 219, for example. Illustratively, as shown in FIG. 5, five swabs 219 may be arranged in each applicator cavity 320. As described above, however, an alternative arrangement is to provide a single cavity, in which the applicators could be positioned side by side. In such an arrangement, for example, the single cavity might hold ten applicators. FIGS. 4A and 5 also show a latch 326 used in conjunction with the package assembly 300. The latch 326 may include first and second latch 326 portions. The latch 326 provides securement of the cover 314 in a closed condition. The specific construct of the latch 326 may be any of a wide variety of arrangements known in the art.

As shown in FIGS. 4A, 4B and 5, the applicator cavity 320 accommodates a plurality of swabs. However, it should be recognized that the swabs 119 may be positioned together in a single package or may be disposed individually in separate containers. For example, the swabs could be individually wrapped. Further, separate containers or packages containing individual swabs may in turn be disposed collectively in a larger container.

Figure 7:
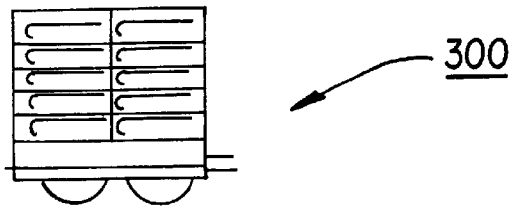
FIG. 7 is a side cross-sectional view of the package assembly of FIG. 6 along the line II—II.
Figure 6:
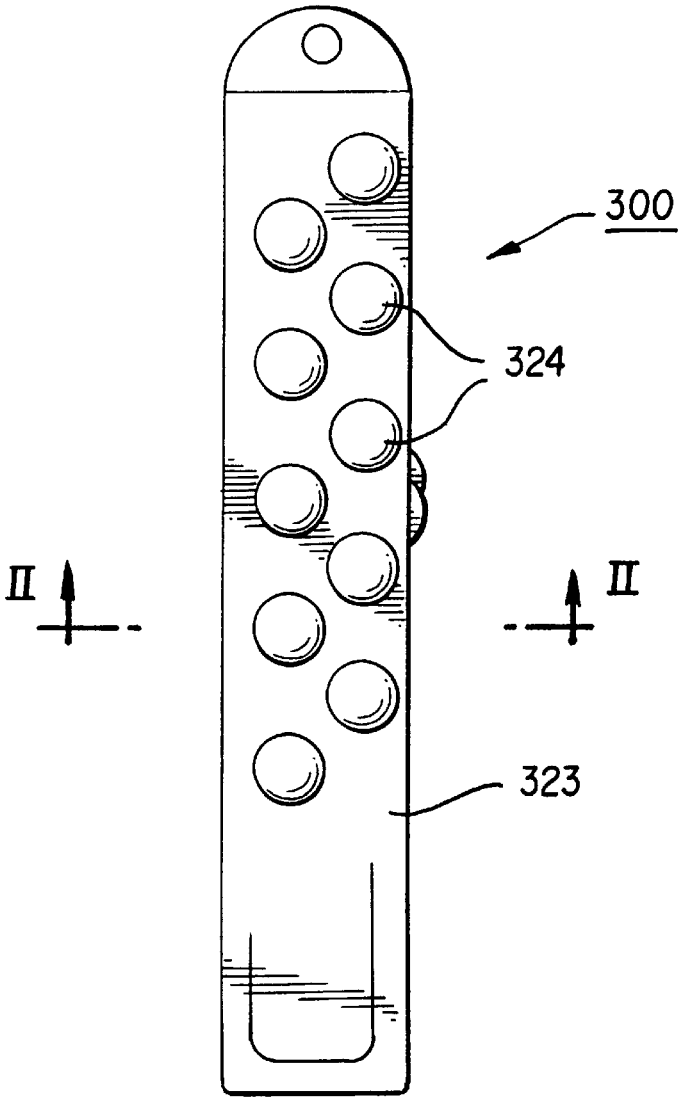
FIG. 6 is a top plan view of the package assembly of FIGS. 4A and 5 with the cover closed.

FIG. 6 is a top plan view of the package assembly 300 of FIGS. 4A and 5 with the cover 314 closed. Further, FIG. 7 is a cross-sectional view of the package assembly 300 of FIG. 6 along the line II—II, showing the cover 314 closed. Specific dimensions of the package assembly 300 of FIGS. 4A–7 may be widely varied depending on the particular application. However, illustratively, the package assembly 300 may be provided with a length of approximately six inches and a width and depth of approximately one inch.

Figure 8:
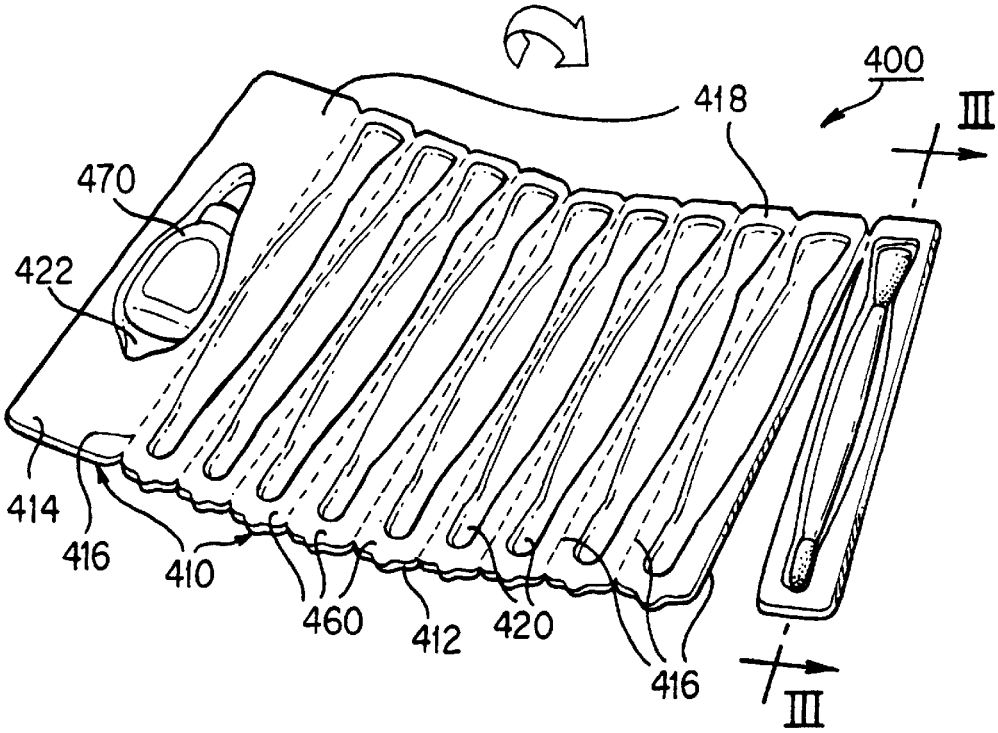
FIG. 8 is a perspective view of another package assembly in accordance with further embodiments of the invention.
Figure 9:
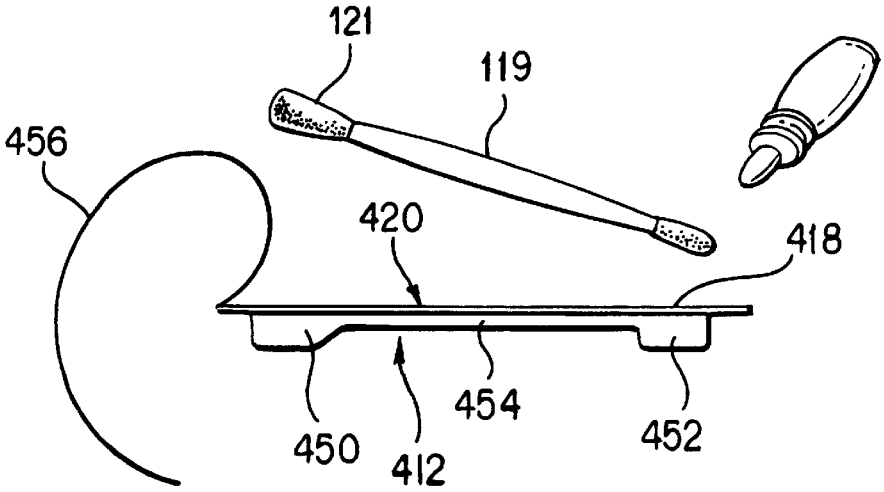
FIG. 9 is a side cross-sectional view of the package assembly of FIG. 8 along the line III—III.
Figure 10:
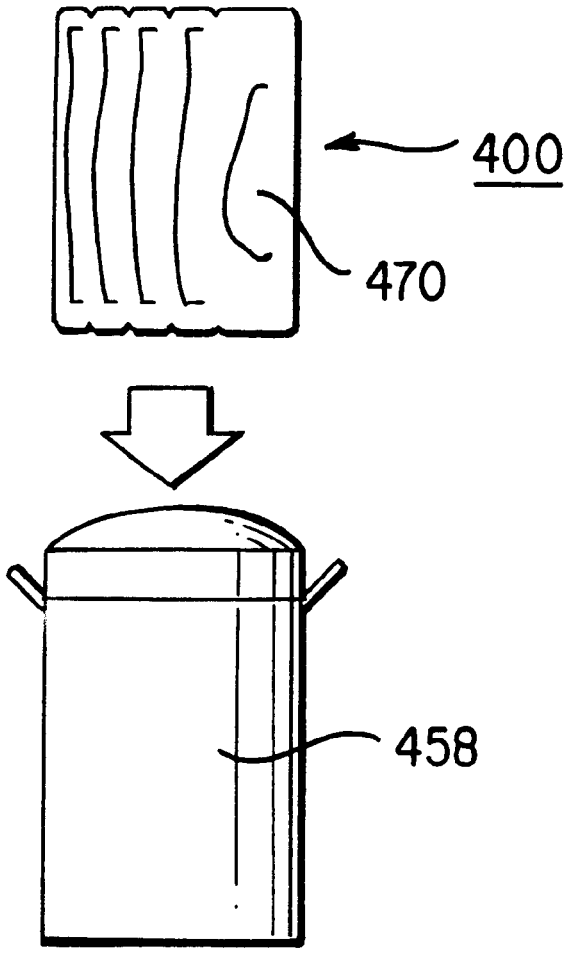
FIG. 10 is a top plan view of the package assembly of FIGS. 8 and 9 in conjunction with a carrying box.

FIGS. 8–10 show a package assembly 400 in accordance with another embodiment of the invention. As shown in FIG. 8, the package assembly 400 includes an enclosure 410 provided with cavities. The enclosure 410 includes an applicator portion 412 and a container portion 414. Further, the portions 412 and 414 may be separated by a hinge or a line of weakness defining a breaking line 416.

The applicator portion 412 includes a plurality of applicator cavities 420 as shown in FIGS. 8 and 9. FIG. 8 shows a package assembly 400 of the invention including ten applicator cavities 420. The applicator cavities 420 each include a first end and a second end. A connection portion 454 extends between the first end and the second end of the applicator cavities 420. A first well 450 is positioned at the first end of each applicator cavity 420. Also, a second well 452 is positioned at the second end of each applicator cavity 420.

Lower surfaces of the first well 450 and the second well 452, as well as the connection portion 454, define a depth relative to the facing surface 418. As is apparent from FIG. 9, the depth of the connection portion 454 is preferably less than the depth of each of the first and second wells 452. Further, the depth of the first well 450 may be greater than the depth of the second well 452. Accordingly, the applicator cavities 420 may be formed in this shape, or any other suitable shape, to accommodate a variety of applicators as well as to act as dip wells and/or drip wells for the adhesive.

The applicator cavities 420 may be separated into distinct cavity portions 460. A single cavity portion 460 includes a single applicator cavity 420 in accordance with a preferred embodiment of the invention. Each distinct cavity portion 460 is separated from an adjacent cavity portion by an additional line of weakening or breaking line 416. The breaking line 416 may be formed using a series of perforations or scoring, similar to the breaking line 416 separating the container portion 414 with the applicator portion 412.

An applicator including the ends 121 may be positioned within the first well 450, the connection portion 454, and the second well 452, as shown in FIG. 9. The applicator cavities 420 may be dimensioned to accommodate any of a wide variety of applicators with absorbent ends 121 which are the same in dimension or different.

A cover such as flexible cover 456 is removably positioned upon the facing surface 418 of the applicator portion 412 and/or the facing surface 418 of the container portion 414. For example, the flexible cover 456 may be laminated upon the package assembly 400 in such a manner that the cover 456 may be peeled back and separated from the facing surface 418. The cover 456 may be formed of cellophane or any other suitable material. The cover 456 in conjunction with the applicator portion 412 can provide each cavity with a seal to prevent the entry of extraneous materials.

The package assembly shown in FIGS. 8 and 9 preferably can be folded or rolled into a compact arrangement. Specifically, the breaking lines 416 can provide flexibility to the package assembly 400 to allow folding or rolling. Illustratively, the package assembly 400 may be folded so as to be inserted into a storage package 458 as shown in FIG. 10.

Figure 11:
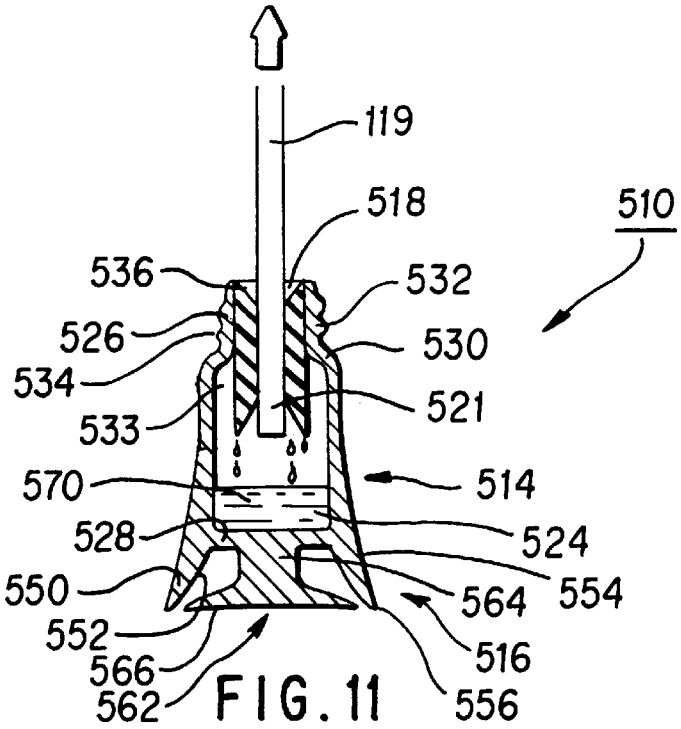
FIG. 11 is a side cross-sectional view of a container assembly according to embodiments of the invention.
Figure 12:
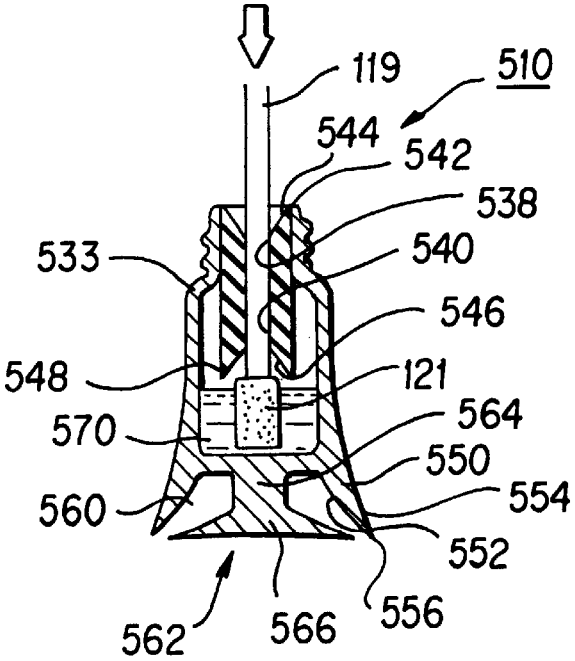
FIG. 12 is a side cross-sectional view of the container assembly of FIG. 11 at a time previous to that shown in FIG. 11.

FIGS. 11 and 12 show a container assembly 510 in accordance with preferred embodiments of this invention. As shown in FIGS. 11 and 12, the container assembly 510 includes a vessel 514, a base 516 and a restrictor 518. The vessel 514 may be formed integral with or removably attachable to the base 516. Further, the restrictor 518 is positioned within vessel 514. An applicator such as a swab 219, as shown in FIG. 3, with an absorbent end 221 may be inserted into and withdrawn from the vessel 514 through the restrictor 518 as shown in FIGS. 11 and 12, respectively.

The base 516 serves to support the receptacle 514 in an upright position to provide access to the interior of the receptacle 514 through the restrictor 518.

The vessel 514 includes an internal lumen 524 and a neck 526. The internal lumen 524 defines a substantially cylindrical or other shape interior including bottom 528 and annular shoulder 530 disposed at the top 532 of the vessel 514 as shown in FIG. 11. The shoulder 530 serves to provide a smooth transition between the interior surface of the internal lumen 524 and the interior surface of the neck 526. It also provides an area 533 into which adhesive material 570 can flow without spilling when the container is tilted. An exterior surface of the neck 526 may include a connecting arrangement 534, including, but not limited, to threads, rings, catches or snaps, for example. The neck 526 includes an uppermost planer surface which forms a rim defining an opening 536. The opening 536 is closable using an appropriately shaped stopper or cap.

The restrictor 518 is positioned within the neck of the vessel 514. The restrictor 518 is preferably substantially cylindrical in shape and includes a central passage 540 extending along the length and through the center of the restrictor 518. The interior of the restrictor 518 includes an interior surface 538 that forms the central passage 540. Further, the restrictor 518 includes a top surface 542. An annular tapered surface 544 can provide a transitional surface between the top surface 542 and the interior surface 538 of the restrictor 518. A lower tapered surface 546 can provide a transitional surface between the restrictor interior surface 538 and the lower end 548 of the restrictor 518, as shown in FIGS. 11 and 12.

A suction cup 566 may be mounted on the lower end of center support 564. The suction cup 566 provides a secure attachment of the container assembly 510 to a supporting surface. As a result, the container assembly 510 of the invention provides for one handed use, thus allowing a user's free hand to hold the object upon which the adhesive material is to be applied, for example. Such is particularly useful in a medical or specifically surgical environment.

Particularly in combination with use of a suction cup, base 516 preferably includes at least one extension that stabilizes the container on a surface. The extension may be in the form of a skirt 550. The skirt 550 extends downwardly from the receptacle bottom 528 and is formed into an annular tapered shape. As shown in FIGS. 11 and 12, the skirt 550 includes an inner skirt surface 552 and an outer skirt surface 554. The inner skirt surface 552 and the outer skirt surface 554 may be tapered toward each other towards a common contact supporting rim 556. The contact supporting rim 556 is positioned on a supporting surface during use of the container assembly 510. The contact supporting rim 556 contacts the supporting surface in a manner such that the container assembly 510 is stabilized during use.

The container assembly 510 including the base 516 with skirt 550, as well as the restrictor, may be formed of any of a wide variety of materials including but not limited to polymerized materials such as plastics, foams, rubbers, thermoplastics, thermosets, metals, for example, or any other suitable material. In general, the only limitation on the materials used to fabricate the container assembly 510 and restrictor is that the material must be sufficiently compatible with the composition to be dispensed that undesirable effects on the composition do not occur during contact of the composition with the container and the restrictor.

Furthermore, in embodiments, the container assembly 510 can be formed of polymeric materials that have been modified by a post-halogenation treatment to be highly resistant to attack, solvation and/or permeation by 1,1-disubstituted ethylene monomer compositions, and thus provide an extended shelf life of the containers and adhesives. Such container assemblies are described in U.S. Provisional Patent Application No. 60/106,093 filed Oct. 29, 1998 and U.S. Provisional Patent Application No. 60/147,259 filed Aug. 5, 1999, the entire contents of which are hereby incorporated by reference.

Further, while the skirt 550 was described as having a annular shape, the skirt 550 is not limited to such shape. Rather, the skirt 550 could be a variety of shapes, including, but not limited to, conical, cylindrical, polygonal, or include a plurality of supports or a segmented annular arrangement, for example.

Illustratively, a process of dispensing and applying an adhesive in conjunction with the assembly 510 of the invention will hereinafter be described. The container assembly 510 is used in conjunction with an applicator such as a swab 119 shown in FIG. 1 or swab 219 shown in FIG. 3, for example. The specific dimensions of the swab should be compatible with the dimensions of the restrictor 518.

When a user desires to apply an adhesive material to the swab 119, an absorbent end 121 may be maneuvered into the upper tapered surface of the restrictor 518 and pushed through the restrictor passage 540. In this manner, the swab 119 is inserted into the vessel 514 through the restrictor 518. The diameter of the restrictor interior surface 538 is slightly less than the uncompressed outer diameter of the absorbent end 121 of the swab 119. As a result, as the swab 119 is passed through the restrictor 518, the material of the absorbent end 121 of the swab 119 is compressed. Once the absorbent end 121 is fully inserted into the vessel 514, the absorbent end 121 is submersed or partially submersed in adhesive material 570. Thereafter, the user withdraws the absorbent end 121 of the swab 119 from the vessel 514 back through the restrictor 518. As the swab 119 is withdrawn through the restrictor 518, the swab 119 will again be compressed. As a result, a portion of the adhesive material 570 which was absorbed and retained by the swab 119 will be forced out of the swab 119 and will drip back into the internal lumen 524 of the vessel 514. As a result, the volume content of the adhesive material 570 retained in the absorbent end 121 after the swab 119 is fully withdrawn from the receptacle assembly 510 may be accurately controlled.

As a user withdraws the swab 119, an upward force will be exerted on the receptacle container assembly 510. The suction cup 566 may be provided, as described above, to retain the receptacle assembly 510 on a supporting surface. Further, an upward force will be exerted on the restrictor 518 so as to tend to separate the restrictor 518 from the vessel 514. However, the restrictor 518 may be retained within the neck 526 using any known method such as well known adhesives or a friction fit, for example.

Figure 13:
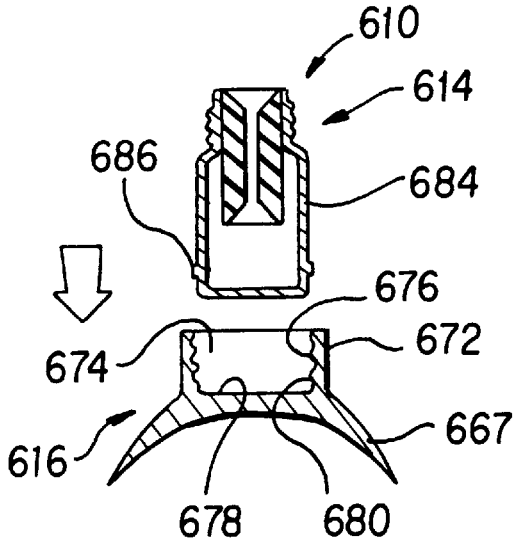
FIG. 13 is a side cross-sectional view of a container assembly in accordance with further embodiments of the invention.
Figure 14:
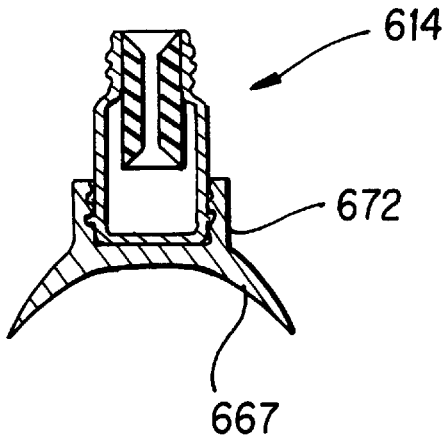
FIG. 14 is a side cross-sectional view of the container assembly of FIG. 13 showing a receptacle and connected base.

FIGS. 13 and 14 show an embodiment of a container assembly 610 in accordance with the invention. In this embodiment, the vessel 614 and the base 616 are not integrally formed. Rather, they are removably connected through the use of a locking retainer 672.

Specifically, the base 616 includes the locking retainer 672 and a suction cup 667 at the lower portion of the locking retainer 672. Illustratively, the locking retainer 672 includes a receiving cavity 674 and a locking channel 676. The receiving cavity 674 includes a lower circular surface 678 and a retainer interior surface 680. The locking channel 676 is formed in the retainer interior surface 680 of the receiving cavity 674. Further, an outer surface of the vessel 614 is formed with a locking ring 686. In the embodiment shown in FIG. 13, the locking ring 686 extends fully around the exterior of the vessel 614. However, such arrangement is not necessary and the locking ring 686 could be segmented, or extend around only a portion of the vessel 614, for example. Further, the locking channel 676 could be segmented or only partially extend around the retainer interior surface 680, for example. FIG. 13 shows the vessel 614 and the base 616 in a separated condition.

Provided the relative positioning as shown in FIG. 13, upon movement of the vessel 614 downward, it passes into the receiving cavity 674 of the base 616. The vessel 614 is guided into the base 616 by the retainer interior surface 680 of the 25 receiving cavity 674. After sufficient downward movement, the bottom surface of the vessel 614 may contact and be supported by the lower surface of the receiving cavity 674, as shown in FIG. 14. At the same time, the locking ring 686 will be opposed to locking channel 676 and will pass into and mate with the locking channel 676. As a result, the vessel 614 will be removably secured to the base 616.

Figure 15:
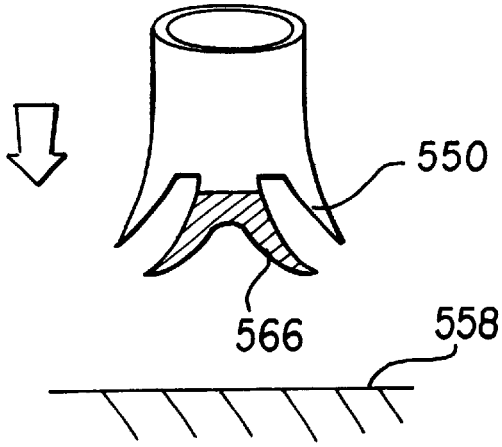
FIG. 15 is a side cross-sectional view of a lower portion of a container assembly in accordance with embodiments of the invention.

FIG. 15 illustrates an operation to mount the assembly 510 of FIG. 11, for example, upon a supporting surface 558 in accordance with the invention. The assembly may be supported upon a smooth surface upon which it is desirable or necessary to support the assembly. The user exerts a downward pressure on the assembly so as to resiliently bend the suction cup 566 and secure the suction cup 566 to the surface, as is well known in the art.

Further, the skirt 550 of the assembly 510 may be somewhat resilient. As a result, downward pressure of the assembly results in slight deformation of the skirt 550. This deformation will occur as the suction cup 566 is being pressed upon the supporting surface 558. The user will release the assembly after the suction cup 566 is sufficiently deformed. Thereafter, due to the resilience of suction cup 566, the suction cup 566 will move to some extent back to the undeformed condition shown in FIG. 15 until the force applied by the suction is equivalent to force exerted due to the resilience of the suction cup 566. As a result, the skirt 550 may be maintained in a somewhat deformed condition and a state of tension is provided between the skirt 550 and the force exerted by the suction cup 566. Accordingly, stability of the assembly is enhanced.

Figure 16:
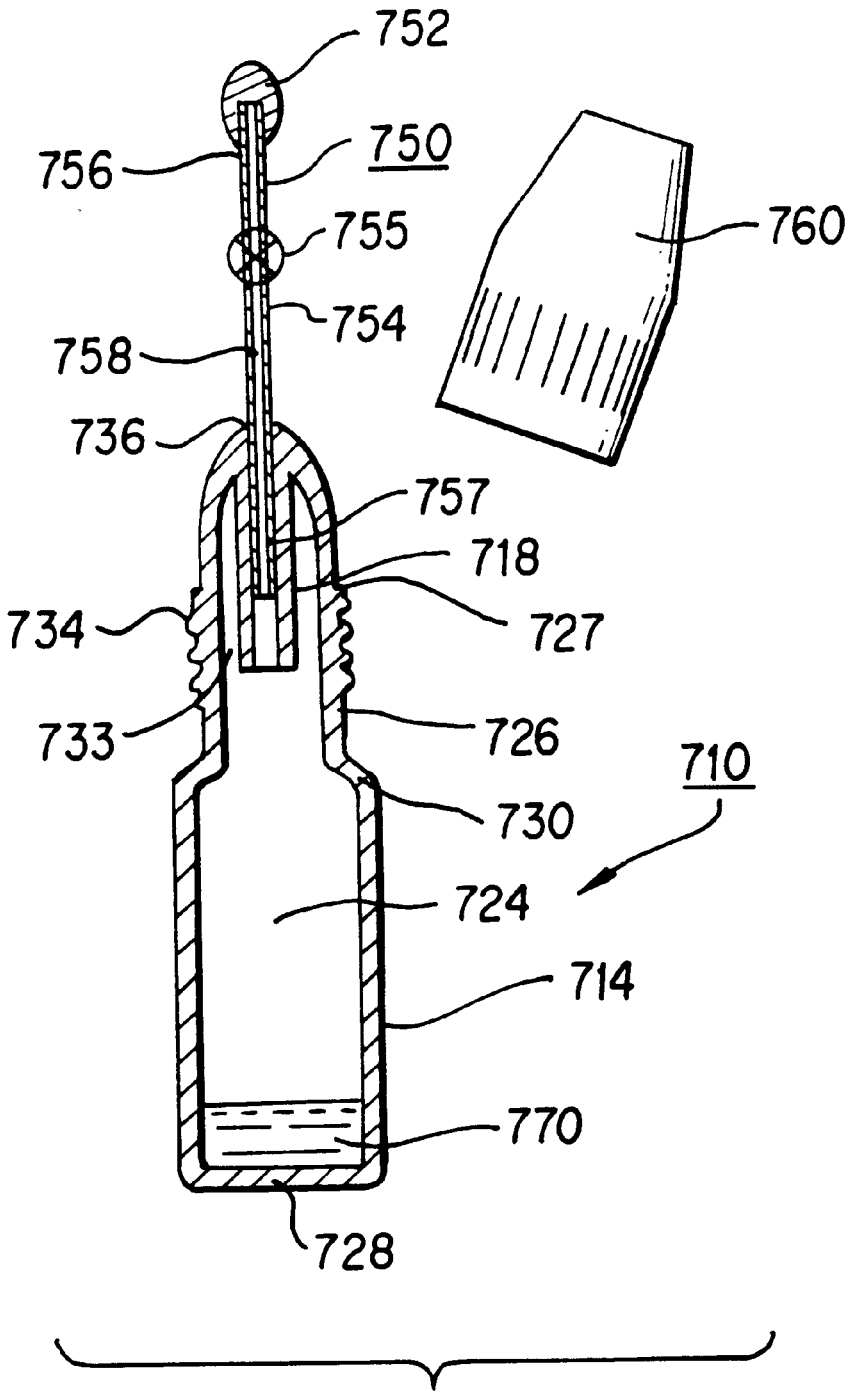
FIG. 16 is a side cross-sectional view of a container assembly and swab according to further embodiments of the invention.
Figure 17:
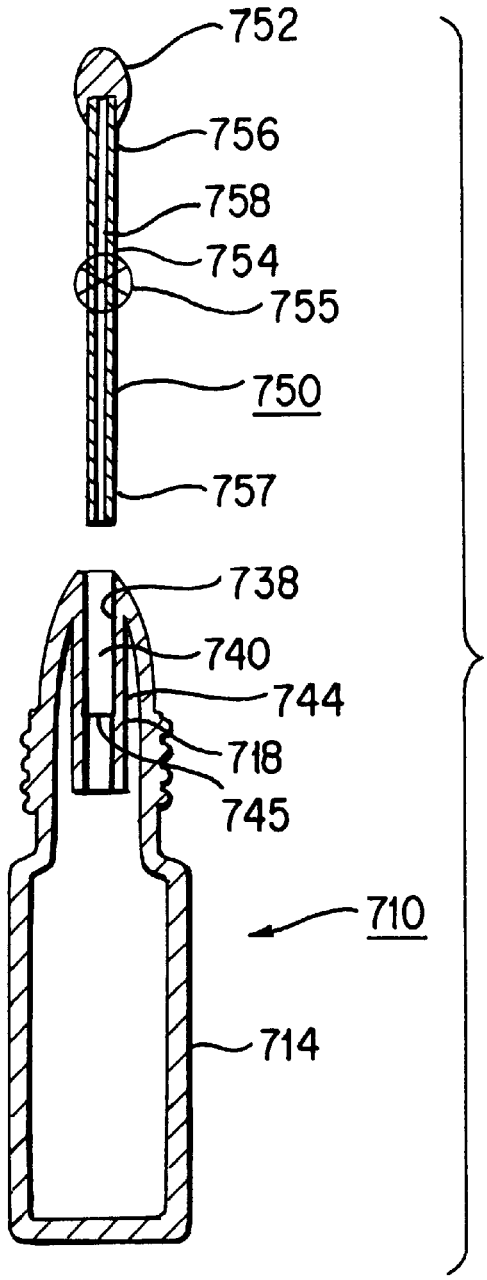
FIG. 17 is a side cross-sectional view of the container assembly of FIG. 16 with the swab removed.

FIGS. 16 and 17 show a container assembly 710 in accordance with further exemplary embodiments of this invention. As shown in FIGS. 16 and 17, the container assembly 710 includes a vessel 714 and an optional applicator retainer 718. The applicator retainer 718 is positioned within the vessel 714. As depicted, it extends substantially into vessel 714, but need not do so in all embodiments. An applicator such as a swab 750 with an absorbent end 752 may be inserted into and retained in the vessel 714 using the applicator retainer 718 as shown in FIGS. 16 and 17, respectively, and described below.

The vessel 714 includes an internal lumen 724 and a neck 726. The internal lumen 724 defines a substantially cylindrical or other shape interior including a bottom 728 and annular shoulder 730. The neck 726 is disposed above the annular shoulder 730 of the vessel 714 as shown in FIG. 16. The annular shoulder 730 serves to provide a smooth transition between the interior surface of the internal lumen 724 and the interior surface of the neck 726. Thus while shoulder 730 is optional, it provides certain advantages. An opening 736 is defined at the top of the neck 726. An exterior surface of the neck 726 may include a connecting arrangement 734, including, but not limited, to threads, rings, catches or snaps, for example. The connecting arrangement 734 may be used to removably hold an appropriately shaped stopper or cap 760. The neck 726 may further include a stopper surface 727 to control the position of the cap 760 when the cap 760 is placed, for example screwed, onto the neck 726. Thus, the opening 736 is closable using the appropriately shaped stopper or cap 760.

In accordance with the invention, the applicator retainer 718 can be positioned within the neck 726 of the vessel 714. The applicator retainer 718 may be substantially cylindrical or other shape. The interior of the applicator retainer 718 includes an interior surface 738, as shown in FIG. 17, that forms a holding passage 740. The holding passage 740 extends along the length and through the center of the applicator retainer 718.

The applicator retainer 718 may be integrally formed with the neck 726, as shown in FIGS. 16 and 17. Alternatively, the applicator retainer 718 may be formed separately from the neck 726. Accordingly, the applicator retainer 718 may be retained within or around the neck 726 using any known method such as well known adhesives or a friction fit, for example.

As shown in FIG. 17, an upper portion of the applicator retainer 718 may include a receiving portion 744. An interior surface 738 of the receiving portion 744 defines a certain inner diameter and shape that cooperate with the outer diameter and shape of a tube portion 754 of swab 750. An optional bead 745 defines a lower edge of the receiving portion 744. The inner diameter of the bead 745 is slightly smaller than the interior surface 738 of the receiving portion 744.

The container assembly 710, as well as the swab 750, may be formed of any of a wide variety of materials including but not limited to polymerized materials such as plastics, foams, rubbers, thermoplastics, thermosets, metals, for example, or any other suitable material. In general, the only limitation on the materials used to fabricate them is that the material must be sufficiently compatible with the composition to be dispensed that undesirable effects on the composition do not occur during contact of the composition with the container assembly 710.

Illustratively, a process of dispensing and applying a medicinal fluid such as an adhesive in conjunction with the container assembly 710 of the invention will hereinafter be described. The container assembly 710 is used in conjunction with an applicator such as the swab 750, for example. The specific dimensions of the swab 750 should be compatible with the dimensions of the applicator retainer 718, as described below.

The swab 750 includes an absorbent end 752 attached to the first end 756 of a tube portion 754. The tube portion 754 also has a second end 757. The tube portion 754 also includes a tubular passage 758 extending from the first end 756 to the second end 757. The absorbent end 752 may be constructed of non-hydrophilic or hydrophilic polyurethane foam, for example, or any other appropriate foam or material as described in the various embodiments of the invention. Further, it should be recognized that swabs according to the other embodiments of the invention, as described herein, may also be constructed of non-hydrophilic or hydrophilic polyurethane foam.

The material, such as foam, forming the absorbent end 752 of the swab 750 can absorb the liquid material contained in the vessel, such as various adhesives. The absorbed liquid material can then be applied to a surface as described below.

The swab 750 may optionally also include a flow-control element such as a valve 755 disposed at some point along the tube portion 754, such as near either end thereof. The valve 755 may be used to limit and/or control fluid flow through the tubular passage 758. For example, the valve 755 may be used to control fluid back-flow. Alternatively, such a valve may be positioned in some portion of the applicator retainer 718.

In embodiments, the valve 755 permits fluid to flow through the through passage 758 substantially only in a direction from the second end 757 to the first end 756 of the swab 750. Accordingly, some contaminants can be prevented from flowing into the vessel 714 and contaminating the contents of the vessel 714. For example, adhesive in which polymerization has been initiated is preferably prevented by the valve 755 from flowing back into the vessel 714 and causing polymerization of adhesive remaining therein. Also, when a sterilized adhesive is contained in the vessel 714 and dispensed through the through passage 758, the adhesive is substantially prevented by the valve 755 from flowing from a portion of the through passage 758 between the valve 755 and the absorbent end 752 of the swab 750, which may have contacted a surface such as human tissue, back into the vessel 714, where the dispensed adhesive or other contaminants may contaminate the sterilized adhesive in the vessel 714.

When a user desires to apply an adhesive material 770 using the swab 750, the second end 757 may be maneuvered into the upper portion of the applicator retainer 718 and pushed into the receiving portion 744 of the holding passage 740, as shown in FIG. 16. In this manner, the swab 750 is inserted into and retained in the applicator retainer 718. The diameter of the interior surface 738 of the receiving portion 744 is preferably slightly less than the outer diameter of the tube portion 754 of the swab 750. As a result, as the second end 757 of the tube portion 754 is passed into the applicator retainer 718, the receiving portion 744 frictionally holds the tube portion 754 of the swab 750. Accordingly, the receiving portion 744 retains the swab 750 in the holding passage 740 in such a manner that the swab 750 is removably retained in the holding passage 740. The bead 745 limits movement of the tube portion 754 into the receiving portion 744.

Once the second end 757 of the swab 750 is inserted and retained in the vessel 714, the vessel 714 may be tilted, inverted and/or squeezed by a user. As a result, the adhesive material 770 flows into the second end 757 of the tube portion 754 and through the tubular passage 758. The adhesive material 770 then flows into the absorbent end 752 of the swab 750. The user may selectively vary the orientation of the container assembly 710 and/or squeezing pressure on vessel 714 to adjust the amount of adhesive material 770 flowing into the absorbent end 752. Thus, the container assembly 710 may be used to apply the adhesive material 770 on any of a wide variety of surfaces.

Once the user applies the adhesive material 770 upon a desired surface, the user may then remove the swab 750 from the vessel 714, as shown in FIG. 17. The user may subsequently insert a new swab 750 into the holding passage 740. The new swab 750 may then be used to apply the adhesive material 770 to a different surface, for example. Thus, by repeatedly exchanging different swabs 750, complete or substantial sterility of the contents of vessel 714, if sterile initially, may be maintained.

The assembly may optionally include a filter or the like to limit or prevent introduction of contaminants from the air into the adhesive material in the vessel 714. Alternatively or in addition, the adhesive material may contain preservatives and/or stabilizers to counteract effects of minor amounts of such contaminants.

Figure 18:
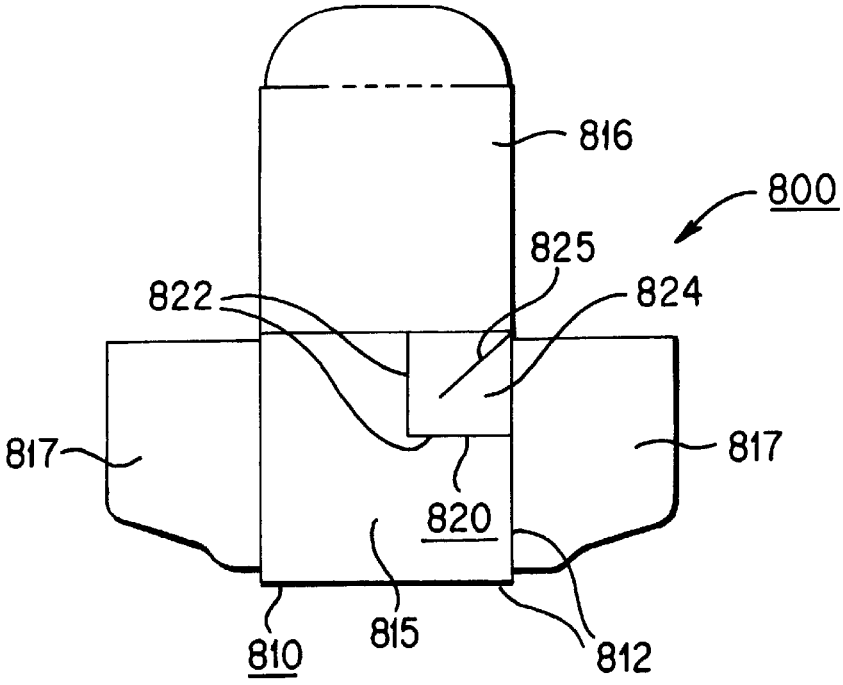
FIG. 18 is a top view of a package assembly in accordance with further embodiments of the invention.
Figure 19:
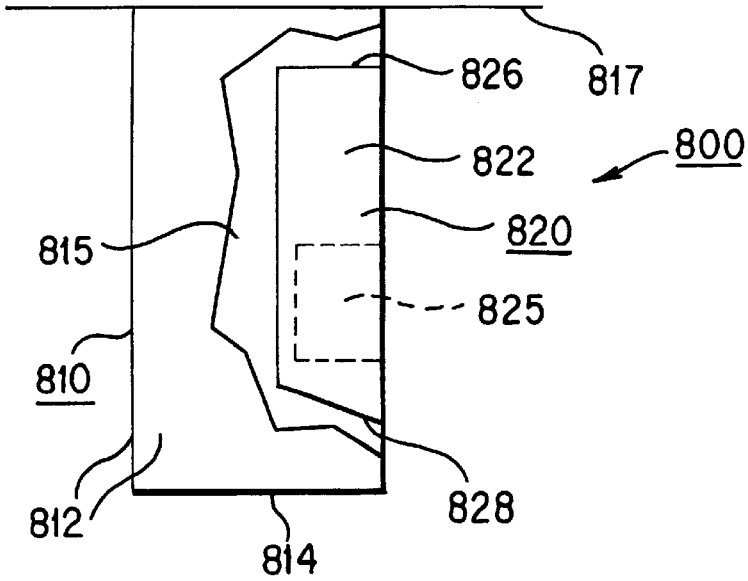
FIG. 19 is a partially cut away front view of the package assembly shown in FIG. 18 in accordance with embodiments of the invention.

FIGS. 18 and 19 show a package assembly 800 in accordance with embodiments of the invention. As shown in FIGS. 18 and 19, the package assembly 800 includes an enclosure 810 constructed of any of a wide variety of materials. The enclosure 810 may be constructed of paper, laminated paper or cardboard, for example. The enclosure may also be constructed of generally non-air permeable materials including various plastics materials and other polymers.

In accordance with the embodiment of the invention shown in FIGS. 18 and 19, the enclosure 810 includes four walls 812 and a bottom 814. The four walls 812 and the bottom 814 form an interior space 815. The enclosure 810 may also include a rear top flap 816 and side flaps 817, as shown in FIGS. 18 and 19.

Further, the package assembly 800 preferably includes a separator 820 positioned within the interior space 815. The separator 820 may also be constructed of paper, laminated paper or cardboard, for example. The separator 820 includes walls 822. The walls 822 are constructed to form a further interior space 824. As shown in FIGS. 18 and 19, the separator 820 including the walls 822 preferably do not extend the entire height of the walls 812 of the enclosure 810. Rather the walls 822 of the separator 820 may extend along only a portion of the wall 812, as shown in FIG. 19. Further, the interior space 824 formed by the walls 822 may be open at the bottom of the interior space 824. Alternatively, the bottom of the interior space 824 may be closed such as by a stop flap 825 extending from a corner of the interior space 824. The stop flap 825 limits the position of an article disposed in the interior space 824.

The top and bottom of each of the respective walls 822 are defined by respective top edges 826 and respective bottom edges 828. The top edges 826 may be horizontal or may be angled. Further, the bottom edges 828 may be horizontal or may be angled. Illustratively, a lower edge 828 is angled as shown in FIG. 19. The specific orientation and size of the walls 822 and the top and bottom edges 826, 828 will vary depending on the particular application of the package assembly 800 and the particular method used to construct the package assembly 800. Further, the separator 820 may be integrally constructed with the enclosure 810. That is, the enclosure 810 and the separator 820 may be constructed of one sheet of paper, for example.

Illustratively, the package assembly 800 may be used to retain the container assembly 710 shown in FIGS. 16 and 17. Specifically, the vessel 714 may be retained in the interior space 824 formed by the walls 822. Further, a plurality of swabs 750 may be stored in the interior space 815 outside the walls 822. Each of the swabs 750 may be individually wrapped in an appropriate manner, for example to maintain the swabs 750 in a clean or even sterile condition. For example, swabs that have been sterilized as described above may be kept sterile in this manner. Further it should be recognized that other swabs as discussed above may be individually wrapped for the same reasons.

In addition to the vessel 714, one or more additional containers of selected medicaments and/or polymerization initiators/accelerators can be provided in the interior space 815 of the package assembly 800. For example, these additional materials can be provided in a separate container within or attached to any of the package assemblies disclosed herein.

The material can be any material, but is preferably an initiator that initiates polymerization and/or cross-linking of the monomer; a polymerization rate modifier, ,which modifies the rate of polymerization of the monomer; and/or a bioactive material, such as a medicament.

Particular initiators and rate modifiers for particular monomers may be readily selected by one of skill in the art without undue experimentation. Control of the molecular weight distribution of the applied adhesive can be enhanced by selection of the concentration and functionality of the initiator or rate modifier vis-a-vis the selected monomer. Suitable polymerization initiators and rate modifiers for cyanoacrylate compositions include, but are not limited to, detergent compositions; surfactants, including nonionic surfactants such as polysorbate 20 (e.g., Tween 20™; ICI Americas), polysorbate 80 (e.g., Tween 80™; ICI Americas), and poloxamers; surfactants such as tetrabutylammonium bromide, quaternary ammonium halides such as benzalkonium chloride or its pure components, and benzethonium chloride; stannous octoate (tin (II) 2-ethylhexanoate), and sodium tetradecyl sulfate; and amphoteric or zwitterionic surfactants such as dodecyldimethyl(3-sulfopropyl) ammonium hydroxide, inner salt; amines, imines, and amides, such as imidazole, tryptamine, urea, arginine and povidine; phosphines, phosphites and phosphonium salts, such as triphenylphosphine and triethyl phosphite; alcohols; methyl gallate; inorganic bases and salts, such as sodium bisulfite, magnesium hydroxide, calcium sulfate and sodium silicate; sulfur compounds such as thiourea and polysulfides; polymeric cyclic ethers such as monensin, and nonactin, cyclic and acyclic carbonates, such as diethyl carbonate; phase transfer catalysts such as Aliquat™ 336 (General Mills, Inc., Minneapolis, Minn.); organometallics; manganese acetylacetonate; radical initiators and radicals, such as di-t-butyl peroxide and azobisisobutyronitrile; and bioactive compounds or agents.

In preferred embodiments, the initiator may be a bioactive material, including quaternary ammonium halides such as alkylbenzyldimethylammonium chloride (benzalkonium chloride; BAC) its pure components, or mixtures thereof, especially those with an alkyl containing 6–18 carbon atoms; benzethonium chloride; benzyl pyridinium halides; and salts of sulfadiazine. Cobalt napthenate can be used as an accelerator for peroxide.

The polymerizable and/or cross-linkable material may also contain an initiator and/or a rate modifier which is inactive until activated by a catalyst or accelerator (included within the scope of the term "initiator" as used herein) in the separate container. Initiators activated by stimulation such as heat and/or light (e.g., ultraviolet or visible light) are also suitable.

In embodiments where the initiator is also a bioactive material, the bioactive material may be supplied in an amount that is effective to initiate polymerization and to be effective for the biological activity intended (e.g., in a sufficient amount to be antiseptic). The bioactive material is selected in conjunction with the polymerizable monomer to be dispensed such that the bioactive material functions as an initiator or rate modifier for the monomer. During application of the compositions, the bioactive material combines with the monomer composition.

As mentioned above, the bioactive material can, but need not, be a polymerization initiator or rate modifier. Where the bioactive material is not an initiator or a rate modifier, an initiator or rate modifier can also be provided along with the bioactive material.

Suitable bioactive materials include, but are not limited to, medicaments such as antibiotics, antimicrobials, antiseptics, bacteriocins, bacteriostats, disinfectants, steroids, anesthetics, fungicides, anti-inflammatory agents, antibacterial agents, antiviral agents, antitumor agents, growth promoting substances, or mixtures thereof.

Exemplary compounds include, but are not limited to, acetic acid, aluminum acetate, bacitracin, bacitracin zinc, benzalkonium chloride, benzethonium chloride, betadine, calcium chloroplatinate, certrimide, cloramine T, chlorhexidine phosphanilate, chlorhexidine, chlorhexidine sulfate, chloropenidine, chloroplatinatic acid, ciprofloxacin, clindamycin, clioquinol, cysostaphin, gentamicin sulfate, hydrogen peroxide, iodinated polyvinylidone, iodine, iodophor, minocycline, mupirocin, neomycin, neomycin sulfate, nitrofurazone, non-onynol 9, potassium permanganate, penicillin, polymycin, polymycin B, polymyxin, polymyxin B sulfate, polyvinylpyrrolidone iodine, povidone iodine, 8-hydroxyquinoline, quinolone thioureas, rifampin, rifamycin, silver acetate, silver benzoate, silver carbonate, silver chloride, silver citrate, silver iodide, silver nitrate, silver oxide, silver sulfate, sodium chloroplatinate, sodium hypochlorite, sphingolipids, tetracycline, zinc oxide, salts of sulfadiazine (such as silver, sodium, and zinc), and mixtures thereof. Preferable bioactive materials are USP approved, more preferably USP monographed.

Preferable medicaments are those that are anions or help in radical generation or that are ion pairs or are themselves radicals.

In embodiments, the medicament is preferably a quaternary ammonium halide such as alkylbenzyldimethylammonium chloride (benzalkonium chloride; BAC) with an alkyl containing 6–18 carbon atoms, its pure components, or mixtures thereof, or benzethonium chloride; or a salt of sulfadiazine, such as a silver, sodium, or zinc salt.

The medicament can have a pharmaceutical effect only at the site of application (i.e., limited to the tissue on/in which it is applied), or it can have a systemic effect (by systemic, it is not only meant that the medicament has an effect throughout the patient's body, but also at a specific site other than the site of application). In embodiments where the medicament is applied in an amount sufficient to show a systemic pharmaceutical activity, it can be absorbed, transported, or otherwise distributed to the site or sites within the patient where the pharmaceutical activity is desired, e.g., through the cardiovascular or lymph systems.

The material may be in the form of a solid, such as a powder or a solid film, or in the form of a liquid, such as a watery, viscous, or paste-like material. The material may also be compounded with a variety of additives, such as surfactants or emulsifiers, and vehicles.

It is preferred to use two-ended applicators with such embodiments, so that the adhesive can be applied with one end before or after the other material is applied with the other end.

According to this invention, in some embodiments, the adhesive and other components of the container assembly and/or package assembly or kit may be sterilized. For example, the adhesive material 570 shown in FIG. 1 may be sterilized. Further, the assembly 510 shown in FIG. 11 including the vessel 514, the restrictor 518 and the swab 119 may also be sterilized. The assembly 510 may be sterilized by the same or a different method as that used for the adhesive material 570. Also, the package assembly or kit 100, shown in FIG. 1, may be sterilized along with its contents. Likewise, the container assembly 710 shown in FIG. 16 can be sterilized along with its contents. Further, the package assembly 800 can be sterilized including the enclosure 810 and contents of the enclosure 810 including any containers and adhesive contained in the containers.

In embodiments, various sterilization processes may be used for the separate components of the package assembly or kit. Examples include, but are not limited to, chemical sterilization (e.g., exposure to ethylene oxide or hydrogen peroxide vapor), physical sterilization (e.g., dry or moist heat) or other techniques such as microwave irradiation, gamma radiation, and ionizing radiation. Especially useful methods for sterilizing include electron beam irradiation, such as the method disclosed in U.S. patent application Ser. No. 09/025,472, the disclosure of which is hereby incorporated by reference in its entirety.

It will be understood that the same or different sterilization technique may be used to sterilize different components of the package assembly. For example, different sterilization techniques can be used to sterilize the separate components of the assembly 510, the assembly 710 and the assembly 800.

It will also be understood that some or all components of the package assembly do not have to be sterilized in some embodiments of this invention. For example, the enclosure 810 of the assembly 800 may optionally not be sterilized in some embodiments. For example, the enclosure 810 may not be sterilized for embodiments in which the enclosure is formed of a material, such as a paper material, that is air permeable.

However, in embodiments in which the enclosure 810 is formed of a non-air permeable material such as a plastics material, the enclosure may also be sterilized. Further, in some embodiments, a non-air permeable material, such as a plastics material, may be applied over an air permeable material such as a paper material. For example, a plastics material may be applied to a cardboard enclosure by a shrink wrapping process. In such embodiments, after applying the plastics material or the like over the enclosure, the package assembly may be sterilized.

In embodiments in which the adhesive monomeric composition and other components of the package assembly are sterilized, the sterilization should not cause more than an acceptable amount of curing and premature polymerization of the adhesive. In embodiments, the adhesive composition may be subjected to multiple sterilization processes to form the package assembly. For example, in the container assembly 710 shown in FIGS. 16 and 17, the adhesive can be sterilized before being placed into the vessel 714. Then, the vessel containing the adhesive as well as swabs 750 can be sterilized. Next, if the vessel and swabs are provided in an enclosure, the enclosure containing the vessel 714 and adhesive and the swabs 750 can be sterilized. Thus, the adhesive should not be prematurely polymerized to more than an acceptable amount after such sequential sterilization has been performed. Preferably, substantially no polymerization of the adhesive occurs during the sequential sterilization.

In some embodiments, electron beam irradiation may be used to sterilize liquid adhesive compositions inside their containers. In preferred embodiments, there is substantially no initiation of polymerization of monomeric liquid adhesive compositions that affects the utility of the monomer or monomers. Benefits of electron beam irradiation include the ability to sterilize the liquid composition on a production line without initiating any substantial polymerization, in a few seconds and at a lower penetration than some other types of irradiation, such as gamma irradiation. The sterilized adhesive compositions have good shelf life and excellent stability. The temperature levels of the adhesive compositions during electron beam irradiation change only slightly from room temperature. In addition, post sterilization microbiological testing and a quarantine period are not required.

In embodiments, the adhesive compositions are sterilized by subjecting the compositions to a sufficient dosage of electron beam irradiation. The adhesive compositions can be sterilized in a container using electron beam irradiation. In addition, in embodiments in which the container is placed in an enclosure, the enclosure can also then be subjected to electron beam irradiation.

In embodiments, the liquid adhesive composition is subjected to a dosage of about 0.5–10 MRad (5–100 kGy), preferably about 1.0–5.0 MRad (10–50 kGy), and more preferably 1–3 Mrad (10–30 kGy), of electron beam irradiation. The time of exposure is relative to the strength of the beam and is typically in the range of tenths of a second to seconds (depending on the conveyor speed) and is preferably less than one minute. Time of exposure will change from day to day depending on the beam strength at the time of setup. Dosimeters may be used to determine the exposure of the samples.

There are several available sources for electron beam irradiation. Two groups of electron beam accelerators are: (1) a Dynamitron, which uses an insulated core transformer, and (2) radio frequency (RF) linear accelerators (linacs). The Dynamitron is a particle accelerator (4.5 MeV) designed to impart energy to electrons. The high energy electrons are generated and accelerated by the electrostatic fields of the accelerator electrodes arranged within the length of the glass-insulated beam tube (acceleration tube). These electrons, traveling through an extension of the evacuation beam tube and beam transport (drift pipe) are subjected to a magnet deflection system in order to produce a "scanned" beam, prior to leaving the vacuum enclosure through a beam window. The dose can be adjusted with the control of the percent scan, the beam current and the conveyor speed.

In embodiments in which electron beam irradiation is used for sterilization of the adhesive compositions, the adhesive compositions may be in any type of at least partially electron beam permeable container, including, but not limited to, glass, plastic, and film-formed packages. In embodiments, the container may be sealed or have an opening. The penetration of electron beam irradiation is a function of the packaging. If there is not enough penetration from the side of a stationary electron beam, the container may be flipped or rotated to achieve adequate penetration. Alternatively, the electron beam source can be moved about a stationary package. In order to determine the dose distribution and dose penetration in product load, a dose map can be performed. This will identify the minimum and maximum dose zone within a product.

In embodiments, after the container containing the liquid adhesive composition is sterilized with electron beam irradiation, the container may be placed in an enclosure forming a package assembly and subjected to a different type of irradiation. The package assembly may then be sterilized. For example, the entire package assembly may be sterilized by chemical (e.g., with ethylene oxide or hydrogen peroxide vapor) or other techniques such as microwave irradiation and electron beam irradiation.

The amount of polymerization that occurs can be determined by various techniques including measuring changes in viscosity of the adhesive compositions. Viscosity changes can provide a measure of the stability of the adhesive compositions.

According to embodiments of the invention, sequential sterilization can be performed with substantially no resulting polymerization of adhesive compositions. Accordingly, the sterilized adhesive compositions can have a satisfactory shelf life.

While this invention has been described in conjunction with specific embodiments outlined above, it is evident that many alternatives, modifications and variations may be apparent to those skilled in the art. For example, various different combinations, and shapes, sizes and arrangements, of the described features are contemplated. Accordingly, the preferred embodiments of the invention as set forth herein are intended to be illustrative, not limiting. Various changes may be made without departing from the spirit and scope of the invention.

What is claimed is:

1. A kit for storing and applying an adhesive material, comprising:

an enclosure;

at least one container within said enclosure;

an adhesive material comprising 1,1-disubstituted ethylene monomers within said at least one container;

a plurality of applicators within said enclosure, each of said applicators comprising at least one absorbent portion.

2. The kit according to claim 1, wherein said at least one container is a bottle.

3. The kit according to claim 1, wherein each of said applicators comprises a shaft having two ends and a said absorbent portion at each end of said shaft.

4. A kit according to claim 3, wherein an initiator or rate modifier for said adhesive material is located at one of said at least one absorbent portions at one end of each of said applicators.

5. The kit according to claim 1, wherein said adhesive material comprises α-cyanoacrylate monomers.

6. The kit according to claim 1, wherein said absorbent portion comprises foam.

7. The kit according to claim 6, wherein said foam comprises an ultraviolet light stabilizing agent.

8. The kit according to claim 1, wherein the container comprises a polymeric material that has been modified by a post-halogenation treatment.

9. A kit according to claim 6, wherein an initiator or rate modifier for said adhesive material is located at said at least one absorbent portion of each of said applicators.

10. The kit according to claim 1, wherein said absorbent portion comprises a fibrous pad.

11. A kit according to claim 10, wherein an initiator or rate modifier for said adhesive material is located at said at least one absorbent portion of each of said applicators.

12. The kit according to claim 1, wherein said enclosure comprises separate compartments for holding said at least one container and said plurality of applicators.

13. The kit according to claim 12, wherein said plurality of said applicators is held within one said separate compartment.

14. The kit according to claim 12, wherein a plurality of said applicators is held within each of a plurality of said separate compartments.

15. The kit according to claim 12, wherein each of said plurality of applicators is held within a said separate compartment.

16. The kit according to claim 15, wherein said separate compartments holding said plurality of applicators are separable from said enclosure.

17. The kit according to claim 16, wherein said separate compartments holding said plurality of applicators are individually separable from said enclosure at predetermined portions of said enclosure.

18. The kit according to claim 15, wherein said enclosure comprises a foldable portion comprising said separate compartments holding said plurality of applicators.

19. The kit according to claim 12, wherein said enclosure further comprises at least one separate well for holding said adhesive material dispensed from said at least one container.

20. The kit according to claim 19, wherein said enclosure comprises a plurality of said wells.

21. The kit according to claim 19, wherein said enclosure comprises at least the same number of said wells as a number of said plurality of applicators.

22. The kit according to claim 19, wherein said enclosure comprises a base and a cover.

23. The kit according to claim 22, wherein said cover is pivotably connected to said base.

24. The kit according to claim 22, wherein said enclosure comprises a plurality of said wells, said cover has a surface facing an interior of said enclosure when said enclosure is closed, and said plurality of wells are disposed on said surface and configured to hold the dispensed adhesive material when said enclosure is open.

25. The kit according to claim 22, wherein said cover comprises a plurality of said wells and a compartment releasably holding said container, and said base comprises a compartment containing said plurality of applicators.

26. The kit according to claim 1, wherein each of said applicators comprises a shaft and said at least one absorbent portion.

27. The kit according to claim 26, wherein said container comprises a closable opening, said opening and said at least one applicator being configured to allow at least said at least one absorbent portion of at least one of said applicators to pass through said opening into said at least one container and to compress said at least one absorbent portion.

28. The kit according to claim 27, wherein said opening is defined by a restrictor that extends into an internal lumen of said container.

29. The kit according to claim 28, wherein said restrictor is formed of a resilient material.

30. The kit according to claim 26, wherein said at least one container comprises a closable opening and is configured to be self-supportable on a surface with said opening facing upwardly.

31. The kit according to claim 30, further comprising at least one suction cup for holding said container to a surface.

32. The kit according to claim 31, wherein said container has a bottom portion, and said bottom portion and said at least one suction cup are configured to be connected together.

33. The kit according to claim 32, wherein said bottom portion further comprises at least one extension that stabilizes said container on said surface.

34. The kit according to claim 33, wherein said extension is in the form of a skirt surrounding said suction cup.

35. A kit according to claim 26, wherein an initiator or rate modifier for said adhesive material is located at said at least one absorbent portion of each of said applicators.

36. The kit according to claim 1, wherein at least the adhesive material and the plurality of applicators are sterilized.

37. The kit according to claim 36, wherein all contents of the enclosure are sterilized.

38. The kit according to claim 1, wherein said applicator is removably connectable to said container.

39. The kit according to claim 38, wherein said container includes an applicator retainer that removably retains said applicator.

40. The kit according to claim 39, wherein said applicator comprises a shaft having a first end and a second end, said shaft having a through-passage extending from the first end to the second end of the shaft, and contents of said container can be dispensed through said through-passage.

41. The kit according to claim 38, wherein said enclosure comprises separate compartments for holding said at least one container and said plurality of applicators.

42. The kit according to claim 41, wherein said enclosure comprises an outer box having walls and a bottom defining an interior space, said separate compartments being disposed in said interior space.

43. The kit according to claim 42, wherein said container is disposed within at least one said compartment and a plurality of said plurality of applicators are disposed within at least one other said compartment.

44. The kit according to claim 41, wherein at least one said compartment includes at least one stop flap to support the container.

45. A method for applying an adhesive material to a surface to be treated using the kit of claim 1, the method comprising:

applying the adhesive material to the exterior surface of one said absorbent portion so that the adhesive material is then absorbed into said absorbent portion; and applying said adhesive material to said surface to be treated by contacting said absorbent portion with said surface to be treated.

46. The method according to claim 45, wherein the surface to be treated is living tissue.

47. The method according to claim 45, wherein said monomers comprise α-cyanoacrylate monomers.

48. The method according to claim 45, wherein at least the adhesive material is sterilized.

49. The method according to claim 48, wherein the applicator and adhesive material are sterilized.

50. The kit according to claim 1, further comprising at least one medicament within at least one second container within or attached to said enclosure.

51. The kit according to claim 50, wherein said applicator comprises a shaft having two ends and a said absorbent portion at each end of said shaft.

52. A kit according to claim 1, wherein said container comprises a multidose bottle containing an amount of said adhesive material sufficient for multiple applications and wherein each of said applicators includes an initiator or rate Modifier for said adhesive material.

53. A kit according to claim 52, wherein said container, said adhesive material and said applicators are sterilized, and wherein each of said applicators is contained in a separate sealed pouch.

54. A kit according to claim 52, wherein said initiator or rate modifier for said adhesive material is located at said at least one absorbent portion.

55. A kit according to claim 1, wherein each of said applicators includes an initiator or rate modifier for said adhesive material.

56. A kit according to claim 55, wherein said initiator or rate modifier for said adhesive material is located at said at least one absorbent portion.

57. The kit according to claim 1, wherein the enclosure includes a ultraviolet light stabilizing agent.

58. A kit for storing and applying an adhesive material, comprising:

an enclosure, said enclosure comprising a base and a cover, said enclosure further comprising separate compartments and a plurality of separate wells, said cover having a surface, and said wells being disposed on said surface and extending out of a plane of said surface;

at least one container within said enclosure;

an adhesive material within said at least one container, said wells being configured to hold adhesive material dispensed from said container;

a plurality of applicators within said enclosure, each of said applicators comprising at least one absorbent portion, said enclosure comprising at least the same number of said wells as a number of said applicators;

wherein separate said compartments are provided for holding said at least one container and said plurality of applicators.

59. The kit according to claim 58, wherein at least the adhesive material and the plurality of applicators are sterilized.

60. The kit according to claim 59, wherein all contents of the enclosure are sterilized.

61. A method for storing and applying an adhesive material, comprising:

opening an enclosure;

removing one of a plurality of applicators from the enclosure, each of the plurality of applicators comprising at least one absorbent portion;

removing from the enclosure a container that contains an amount of an adhesive material comprising 1,1-disubstituted ethylene monomers sufficient for a plurality of applications;

dispensing a portion of the amount of the adhesive material to at least one of a plurality of wells, the wells being disposed on, and extending out of a plane of, a surface of the enclosure;

contacting an absorbent portion of the one applicator with the amount of the adhesive material in the well; and applying adhesive from the applicator.

62. The method of claim 61, further comprising:

removing a second of the plurality of applicators from the enclosure;

dispensing a second portion of the amount of the adhesive material to an unused well of the plurality of wells when the enclosure is open;

contacting an absorbent portion of the second applicator with a second amount of the adhesive material in that well; and applying adhesive from the applicator.

63. A kit for storing and applying an adhesive material, consisting essentially of:

an enclosure;

at least one container within said enclosure;

an adhesive material comprising 1,1-disubstituted ethylene monomers within said at least one container; and a plurality of applicators within said enclosure, each of said applicators comprising at least one absorbent portion.

64. A kit for storing and applying an adhesive material, comprising:

an enclosure;

at least one container within said enclosure;

an adhesive material comprising 1,1-disubstituted ethylene monomers within said at least one container;

a plurality of applicators within said enclosure, each of said applicators comprising at least one absorbent portion; and a removable insert within said enclosure, the removable insert defining at least one open cavity containing at least said plurality of applicators.

65. The kit of claim 64, wherein said removable insert further contains said at least one container.

66. The kit of claim 65, wherein said removable insert defines a separate cavity for said at least one container.

67. The kit of claim 66, wherein said separate cavity is designed to hold said at least one container in place.

68. A method for storing and applying an adhesive material, comprising:

opening an enclosure;

removing one of a plurality of applicators from the enclosure by removing an insert containing the plurality of applicators from the enclosure and removing an applicator from the insert, each of the plurality of applicators comprising at least one absorbent portion;

removing from the enclosure a container that contains an amount of an adhesive material comprising 1,1-disubstituted ethylene monomers sufficient for a plurality of applications;

applying a portion of the amount of the adhesive material to the at least one absorbent portion of the one applicator; and applying adhesive from the applicator.

69. The method of claim 68, wherein removing the insert further comprises removing the container from the enclosure.

70. A method for storing and applying an adhesive material, comprising:

opening an enclosure;

removing one of a plurality of applicators from the enclosure, each of the plurality of applicators comprising at least one absorbent portion;

removing from the enclosure a container that contains an amount of an adhesive material comprising 1,1-disubstituted ethylene monomers sufficient for a plurality of applications;

applying a portion of the amount of the adhesive material to the at least one absorbent portion of the one applicator; and applying adhesive from the applicator to at least one of an incision, a laceration, a wound, a burn, an inflammation and a sore.

71. A compact kit for storing and applying an adhesive material, comprising:

an enclosure having no dimension greater than approximately six inches;

at least one container within said enclosure;

an adhesive material comprising 1,1-disubstituted ethylene monomers within said at least one container; and a plurality of applicators within said enclosure, each of said applicators comprising at least one absorbent portion.

* * * * *